United States Patent [19]

Schellstede et al.

[11] Patent Number: 4,790,384

[45] Date of Patent: Dec. 13, 1988

[54] HYDRAULIC WELL PENETRATION APPARATUS AND METHOD

[75] Inventors: Herman J. Schellstede, New Iberia, La.; Robert W. McQueen; Alan D. Peters, both of Houston, Tex.

[73] Assignee: Penetrators, Inc., Houston, Tex.

[21] Appl. No.: 42,191

[22] Filed: Apr. 24, 1987

[51] Int. Cl.[4] ..... E21B 43/112; E21B 7/18

[52] U.S. Cl. ..... 166/298; 92/110; 166/55.1; 166/55.3; 166/223; 166/383; 175/62; 175/67; 175/78; 175/79

[58] Field of Search ..... 166/298, 55.3, 223, 166/383, 55.1; 175/62, 67, 78–80, 77, 267, 286; 92/110, 111; 91/196

[56] References Cited

U.S. PATENT DOCUMENTS

| | | | |
|---|---|---|---|
| Re. 29,021 | 11/1976 | Archibald et al. | 175/213 |
| 1,495,949 | 5/1924 | Carroll | 92/110 |
| 2,018,285 | 10/1935 | Schweitzer et al. | 166/223 X |
| 2,258,001 | 10/1941 | Chamberlain | 175/67 |
| 2,271,005 | 1/1942 | Grebe | 166/50 X |
| 2,345,816 | 4/1944 | Hays | 175/67 X |
| 2,426,106 | 8/1947 | Kinley | 166/55.1 |
| 2,699,921 | 1/1955 | Garrison | 175/267 |
| 2,707,616 | 5/1955 | Schad et al. | 175/61 X |
| 2,743,703 | 5/1956 | Miller | 92/110 X |
| 2,758,653 | 8/1956 | Desbrow | 166/73 |
| 2,796,129 | 6/1957 | Brandon | 166/50 X |
| 2,838,117 | 6/1958 | Clark, Jr. et al. . | |
| 2,852,230 | 9/1958 | Garrison | 175/78 X |
| 3,130,786 | 4/1964 | Brown et al. | 166/55 |
| 3,145,776 | 8/1964 | Pittman | 166/55 |
| 3,202,062 | 8/1965 | Burden | 92/111 X |
| 3,301,337 | 1/1967 | Vaughn et al. | 166/298 X |
| 3,318,395 | 5/1967 | Messmer | 166/223 X |
| 3,370,887 | 2/1968 | Knutson et al. | 299/4 |
| 3,400,980 | 9/1968 | Dahms et al. | 299/5 |
| 3,402,965 | 9/1968 | Dahms et al. | 299/4 |
| 3,402,967 | 9/1968 | Edmonds et al. | 299/5 |
| 3,511,133 | 5/1970 | Day | 92/110 X |
| 3,547,191 | 12/1970 | Malott | 166/223 |
| 3,873,156 | 3/1975 | Jacoby | 299/4 |
| 4,022,279 | 5/1977 | Driver | 166/271 |
| 4,050,529 | 9/1977 | Tagirov et al. | 175/422 |
| 4,134,453 | 1/1979 | Love et al. | 166/298 |
| 4,317,492 | 3/1982 | Summers et al. | 175/79 |
| 4,346,761 | 8/1982 | Skinner et al. | 166/206 |
| 4,365,676 | 12/1982 | Boyadjieff et al. | 175/61 |
| 4,640,362 | 2/1987 | Schellstede | 175/78 X |

FOREIGN PATENT DOCUMENTS

| | | | |
|---|---|---|---|
| 747985 | 7/1980 | U.S.S.R. | 175/77 |

*Primary Examiner*—Hoang C. Dang

*Attorney, Agent, or Firm*—Mason, Fenwick and Lawrence

[57] ABSTRACT

A well casing penetrator includes an elongated housing enclosing an outwardly movable hydraulic cylinder driven punch for cutting an opening in a casing. A high pressure liquid jet nozzle is mounted on the end of a hose which moves outwardly through an axial bore in the punch when extended through the casing to cut a radially extending opening in the surrounding earth. The punch includes arcuately curved longitudinal slots along opposite sides which cause tabs to be bent back along opposite sides of the opening cut in the casing to prevent dislodging of any portion of the casing from the casing as a consequence of the operation of the punch. A spool piston is connected to a single accumulator that is pressurized to urge the spool piston toward a first position in which work fluid controlled by the spool piston retracts the hydraulic punch cylinder and a hose drive cylinder for moving the hose in the punch. When the pressure is increased the accumulator is overcome and the punch cylinder and the hose drive cylinder are activated along with apparatus supplying work fluid to the hose to initiate a penetration operation. The parts return to their original retracted position upon lowering of the work pressure.

28 Claims, 11 Drawing Sheets

13C
206
206A
208
206C
206A
208
210C
210A
12
168
166
12
252
252
208
208
256
250
230
210A
193
193
181
177
179
12
183
311
E
185
313
169
264
264
171
170
175
E
210A
210C
230
254
212
13C 13D
212
12
230
230
210A
244
12
244
230
210A
248
214
232
232
242
212
250A
243
238
235
13D 124B
128
130
132
124D
194
128
138
134
174D
178
136
174B
176B
143
138
190
139
143
139
182
180D
182
182
160
136
140
150
146
151
150
131
162
190
190
186
194
164
196
168
198
200
208
206C
208
206A
168
210C
208
164
252
250
208
208
254
254
12
12
244
164
208

HYDRAULIC WELL PENETRATION APPARATUS AND METHOD

BACKGROUND OF THE INVENTION

The present invention is in the field of oil and/or gas well casing perforation apparatus, procedures and methods. More specifically, the present invention is directed to a unique apparatus and method employing a high pressure fluid driven punch for cutting an opening in a well casing and subsequently cutting a passageway through the surrounding earth by the use of a high pressure jet for a substantial distance outwardly beyond the casing for permitting the flow of liquid or gaseous hydrocarbons into the casing.

The vast majority of oil and gas wells are drilled by the use of rotary drilling procedures in which drilling mud containing extremely fine particles is forced downwardly through the drilling string and out through the bit for the removal of cuttings, cooling and other beneficial results. A commonly employed material in drilling mud comprises extremely small particles of barite. It has been found that the earth surrounding a drill bore is contaminated outwardly by the drilling fluid for a distance of between eighteen inches and four feet beyond the bore. This contamination, being largely formed of minute particles from the mud, frequently presents a substantial barrier to the inflow of hydrocarbons to the well casing.

Moreover, invasion of the formation by cementing and well completion fluids creates additional formation contamination. The zone around a well bore which has been contaminated or plugged by drilling fluid, cement or completion fluids is termed the invaded zone or damaged zone and the effect is called formation damage, skin damage or skin effect. "Skin effect" is a petroleum engineering measure of the extent of damage or resistance to flow of fluids around a well bore and is expressed as a dimensionless number. A high skin effect number or factor representing extensive formation damage for example would be 10, whereas a low skin effect number would be 0.

A number of expedients have been proposed and employed in an effort to provide flow passageways through the surrounding strata or to remove skin effect for permitting and increasing the flow of hydrocarbons into the well casing. Probably the most common expedient is the use of projectiles fired from gun-like devices positioned in the casing; however, the projectiles from such devices are normally incapable of penetrating beyond the zone of contamination and optimum flow conditions consequently cannot normally be achieved by the use of such devices. Consequently, a variety of other proposals for penetrating the surrounding strata have come forward. For example, U.S. Pat. No. 4,022,279 proposes a method of boring spiral bores a substantial distance outwardly from a well casing for increasing production. However, this patent does not disclose a specific apparatus for effecting the desired spiral bores and it is not certain that such structure actually exists.

U.S. Pat. No. 3,370,887 discloses a fracturing device employing a blow-out plug 11 which is blown radially outwardly through the well casing by high pressure injected into the housing in which the plug is mounted. Dahms, et al. U.S. Pat. Nos. 3,400,980 and 3,402,965 both disclose a tool which is moved downwardly out the lower end of the well casing and from which extendible pipe or hose members move outwardly while discharging high pressure liquid to provide a cavity at the lower end of the well. The device of this patent is employed for the mining of salts. Edmunds, et al. U.S. Pat. No. 3,402,967 discloses a device that is similar in operation to the Dahms, et al. patents.

Malott U.S. Pat. No. 3,547,191 discloses an apparatus that is lowered into a well for the discharge of high pressure liquid through nozzle means 26, 27. The discharge from the nozzle means passes through previously formed openings 35 in the casing.

Messmer U.S. Pat. No. 3,318,395 discloses a tool including a body of solid rocket propellant fuel 34 which is lowered to a desired position in a well. The rocket fuel is ignited and the exhaust discharges outwardly through nozzle means 36 to cut through the casing and the cement surrounding the casing. The discharge from the rocket includes abrasive particles which aid in the cutting operation and also serve to cut a notch in the surrounding formation to fracture same and hopefully improve production. However, as the discharge from the rocket, or any other fixedly positioned jet means, erodes the formation, the standoff distance between the nozzle and the formation increases and the effectiveness of the apparatus is greatly reduced.

The Tagirov, et al. U.S. Pat. No. 4,050,529 discloses a tool which is lowered down a well casing and includes nozzle means through which high pressure abrasive containing water is pumped to cut through both the casing and the surrounding formation. The use of abrasive materials pollutes the well forever in that it creates monumental wear problems in valves, pumps and the like subsequently used with the well. The abrasive is absorbed in the surrounding formation and also blocks the pores of the formation.

Skinner, et al. U.S. Pat. No. 4,346,761 discloses a system including nozzles 20 mounted for vertical up and down movement in the casing to cut slots through the casing. The nozzle means does not protrude beyond the casing; however, the high pressure jet discharged from the nozzle would apparently effect some cutting of the surrounding strata.

Other patents disclosing high pressure nozzles for cutting well casings include Brown, et al. U.S. Pat. No. 3,130,786; Pitman U.S. Pat. No. 3,145,776 and Love, et al. U.S. Pat. No. 4,134,453. Archibald U.S. Pat. No. Re. 29,021 discloses an underground mining system employing a radial jet which remains in the well bore for cutting the surrounding formation. Summers U.S. Pat. No. 4,317,492 discloses a high pressure water jet type well system usable in mining and drilling operations in which a nozzle providing a jet is moved out the bottom of the well and is then moved radially. Jacoby U.S. Pat. No. 3,873,156 also discloses a jet-type mining device movable out the lower end of a well for forming a cavity in a salt well. Boyadjieff U.S. Pat. No. 4,365,676 discloses a mechanical drilling apparatus moveable radially from a well for effecting a lateral bore hole. A number of additional U.S. patents disclose the employment of high pressure nozzle means for cutting the strata adjacent or at the bottom of a well with these patent including U.S. Pat. Nos. 2,018,285; 2,258,001; 2,271,005; 2,345,816; 2,707,616; 2,758,653; 2,796,129 and 2,838,117.

None of the aforementioned prior art devices have achieved any substantial degree of success due to a variety of shortcomings. For example, those devices which simply project a high pressure jet from a nozzle positioned inside the casing cannot cut outwardly from the casing a sufficient distance to be truly effective. Moreover, the direction and extent of the cut provided by such devices is subject to a number of variable parameters including the nature of the surrounding formation and it is therefore difficult to achieve a predicable result. One problem with all high pressure type jet devices operating thrugh the wall of the well casing is that an aperture must be cut in the casing and the surrounding cement as a prerequisite to cutting through the surrounding formation. In some of the prior known devices the aperture can be cut with the nozzle jet itself whereas other devices require the use of separate mechanical cutting means. Those devices using nozzle jets for cutting through the casing suffer from a very serious drawback in that the cutting liquid frequently includes abrasive particles which remain in the casing and can subsequently adversely effect valves or other components such as pumps or the like into which some of the abrasive components are eventually inducted.

The use of separate mechanical cutting devices suffers from the shortcoming of requiring substantial additional expense both in terms of the cost of the extra equipment and the cost of time required in using same for cutting the casing. This is true because such use will normally require lowering of the cutting device to the bottom of the well, cutting of the casing and subsequent removal of the cutting device and positioning of the jet means in the casing prior to usage of the nozzle jet-type cutter. The positioning and removal of tools from the well normal requires a time consuming and expensive pulling and replacement of the string.

A common shortcoming of all types of penetrators prior to the invention of U.S. Pat. No. 4,640,362 (Schellstede) was that they simply did not result in adequate penetration of the formation outwardly of the casing a sufficient distance to achieve improved production. Therefore, there had been a very substantial need for apparatus capable of effectively penetrating the earth formation surrounding a well casing for a distance outwardly beyond the casing outside the contamination zone surrounding the casing. A particular problem was the inability of many devices prior to Schellstede to maintain a proper standoff distance from a cutting jet providing means.

The invention of the aforementioned Schellstede patent represented a very significant advance in the penetration art in that it permitted penetration of the earth formation well beyond the contamination zones surrounding the casing so as to provide a very superior performance compared to the prior known devices. Additionally, it permitted an initial jetting of cement away from the casing prior to outward movement of the jet providing semi-rigid, extendable, conduit and nozzle extension device; moreover, the Schellstede device had other advantageous features flowing from its unique design. However, the device of the Schellstede patent is somewhat complicated in requiring hydraulic circuitry which includes two nitrogen accumulators, rotor actuators and valve sets and tubing flow lines all of which were mounted in a ten foot housing. Additionally, operation of the Schellstede device requires that pressurized working fluid be provided to the apparatus at four different pressures each at different times during each cycle of operation. The overall length of the complete apparatus is consequently substantial and the use of the flexible flow lines creates a substantial potential for leakage in view of the high pressure required during usage of the apparatus.

It is consequently the primary object of the present invention to provide a new and improved apparatus and method for penetrating earth formations around a well casing which is smaller, less complicated, and more trouble free than the prior known systems.

Another object of the invention is the provisions of a simplified control head for a lance type well penetrator using a semi-rigid extendable, conduit and nozzle extension device.

SUMMARY OF THE INVENTION

The preferred embodiment of the invention comprises an elongated generally cylindrical tube having a cam drive cylinder for driving a wedging cam to extend a radially movable punch outwardly through the casing of a well. A extendable semi-rigid, extendable conduit and nozzle extension device or "lance" which has a nozzle at its outer end is positioned to move axially outward through an axial bore in the punch so that it provides a small additional force outwardly on the casing. After the punch penetrates the casing, the nozzle moves outwardly beyond the casing to provide a bore extending outwardly through the formation from the opening provided in the casing. The operation of the nozzle during the initial opening movement of the casing outwardly by the punch serves to wash out and remove cement that is behind the casing so as to permit the punch to more quickly effect the provision of the opening in the casing. A single accumulator is provided with pressurized nitrogen at a desired pressure dependent upon the desired opening pressure of the apparatus. An accumulator piston on a spool piston rod is provided in a cylinder in the accumulator and is normally urged to a first position by the accumulator pressure in which a lance drive cylinder connected to the lance for moving the lance to and from its extended position receives working fluid to retain the lance in its retracted position. Also, working fluid at a relatively low pressure is directed to the punch cam drive cylinder to position it in a retracted position so that the punch is retracted. while the last two functions are taught in the Schellstede patent, the present invention employs different control means for effecting these functions. A penetration operation is initiated by providing higher pressure working fluid, normally water, to the piston spool assembly with the working fluid being at a sufficiently high pressure to overcome the force exerted by the accumulator on the piston spool assembly to result in a shifting in the piston spool assembly to a second position. The shifting movement of the piston spool lance drive cylinder and the punch drive cam clyinder so that these cylinders are actuated to essentially simultaneously extend the punch outwardly and move the lance and nozzle outwardly through the punch while simultaneously supplying working fluid at a high pressure through the lance. The working fluid in the lance flows through the nozzle and initially impinges on the interior of the casing in the area being punched by the punch to create a small additional force on the casing area to slightly speed up the failure of the casing area engaged by the punch and to permit the working fluid to immediately flow outwardly into the formation as soon as a crack develops in the casing area and contacted by the punch. Consequently, the cement and formation is eroded away behind the casing area so as to permit an easy deflection outwardly of side tabs of the casing resultant from the punch movement. After the opening is completed the lance continues outwardly with the nozzle discharging into the formation to provide an opening extending outwardly several feet beyond the casing so as to enable subsequent enchanced production of the well. When the penetration operation is completed, the pressure is permitted to return to its lower level so that the piston spool assembly shifts back to its first position to cause the lance drive cylinder and the punch cam cylinder to return to heir initial positions so that the punch and the lance are retracted back into the housing of the apparatus.

DESCRIPTION OF THE PREFERRED EMBODIMENT

Figure 1:
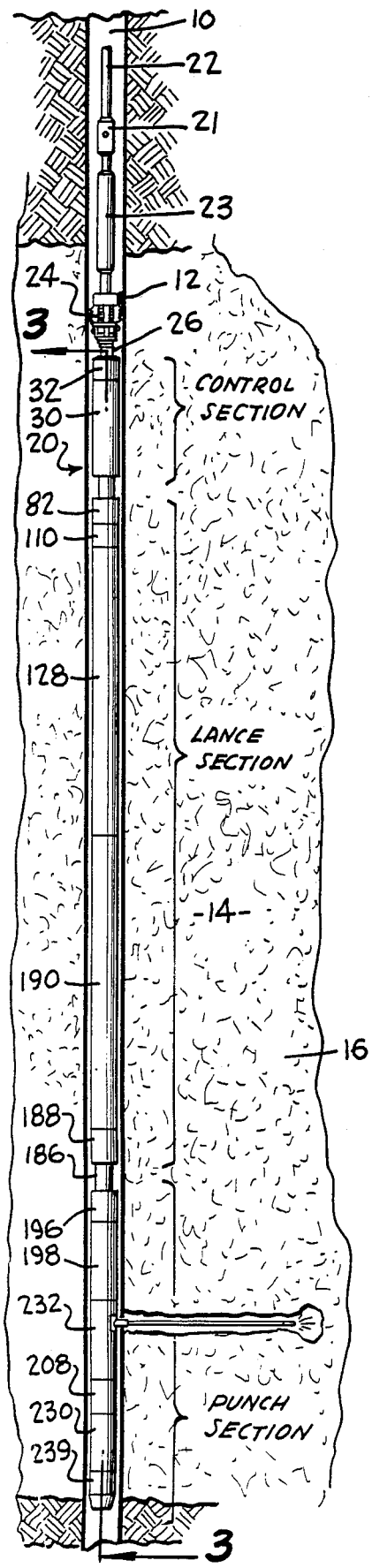
FIG. 1 is a side elevation view illustrating a gas or oil well in section and in which the downhole apparatus preferred embodiment of the present invention is being used for perforating the casing and surrounding formation.

Attention is initially invited to FIG. 1 of the drawings which illustrates the employment of the preferred embodiment of the invention in a well 10 having a casing 12 extending downwardly through an oil, gas, or water bearing strata 14. An invalid zone 16 extends outwardly around the casing and comprises drilling mud constituents forced into the strata during the drilling operation. Additionally, the area immediately surrounding the casing will normally be cemented to provide a cement blanket surrounding the casing at the completion of the well.

The present invention comprises an elongated downhole apparatus 20 suspended from the surface by a pipe string 22 comprising a plurality of conventional tubular pipe sections with the lowermost pipe section being connected to a circulating valve 21, a filter 23 and a stabilizer/anchor 24 both of conventional construction which includes selectively operable means expandable outwardly for engagement with the inner wall of casing 12 to anchor the stabilizer/anchor in fixed position. The upper end of elongated apparatus 20 is supported from stabilizer/anchor 24 by a threaded connection 26.

The upper above-ground end of the string 22 is connected as shown in FIG. 1 of the Schellstede patent to a swivel supported by conventional means on a workover rig or the like and connected to a low pressure hose and a high pressure hose to sources of pressurized fluid. The hose members extend from a vehicle having a console control panel mounted. Additionally, the vehicle includes a motor driving conventional high pressure and low pressure pump means connected to the hose member and controlled from the console control panel. The pumps receive working fluid from a suction line extending from a conventional two-stage element filter assembly which receives the unfiltered working fluid from a tank truck and filters out all particles greater than 20 microns in size; however, even finer filters can be used. The high pressure pump is an acid service trimmed five piston positive displacement pump which provides a low frequency pulsating output, the frequency of which can be adjusted. Pumps with a different number of cylinders could also be employed.

The elongated downhole apparatus 20 is formed of a plurality of connected tubular housing members in which various functions and equipment are provided. The housing function providing sections from top to bottom as illustrated in FIG. 1 include a control section, a lance section and a punch section as shown.

Figure 3A:
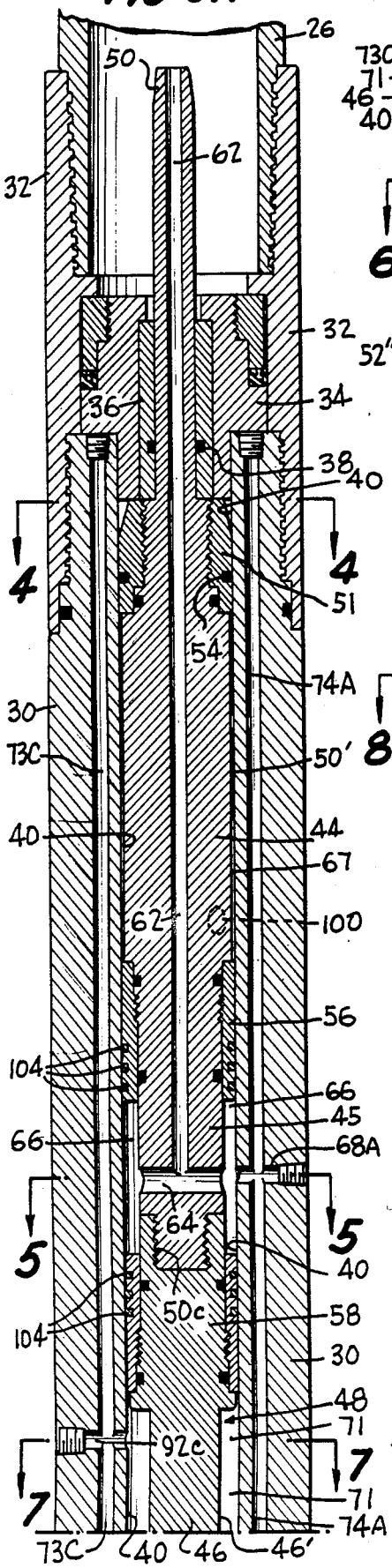
FIGS. 3A, 3B, 3C, 3D, 3E, 3F, 3G and 3H are sectional views taken along line 3—3 of FIG. 1 progressively from the top to the bottom of the apparatus as shown in FIG. 1 and with the parts in position prior to initiation of a penetration operation.
Figure 3B:
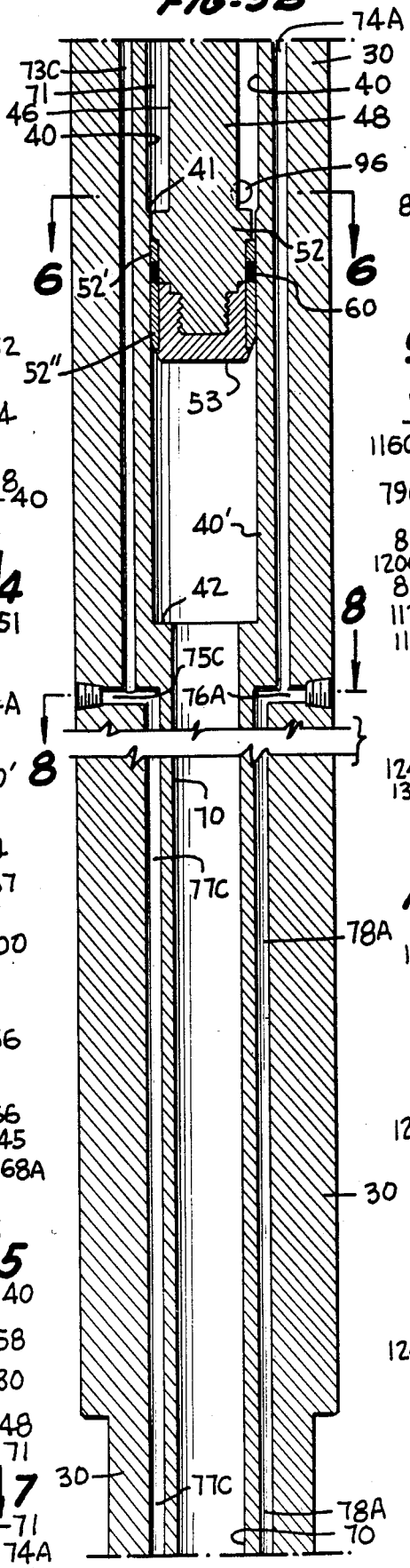

The control section is best illustrated in FIGS. 3A, 3B, 3C, 14A and 14B and comprises a cylindrical control housing or cylinder 30 having a threaded control sub 32 connected at its upper end for retaining a head block 34 on the upper end of the main control housing. The head block 34 includes an axial bore in which a cylindrical seal 36 including an O ring 38 is mounted. An upper cylindrical bore 40 extends downwardly from the upper end of the control housing 30 with the lower end of the upper bore being defined by an annular shoulder 41 below which a smaller axial bore 40' extends downwardly to a radial shoulder 42 as shown in FIG. 3B.

A spool piston assembly 44, 48 is mounted for axial reciprocation in bore 40 and is formed of an upper spool component 44 and a lower spool component 48 which are threadably connected at 50C as shown in FIG. 3A. The upper end of the upper component 44 comprises a rod extension 50 immediately below which an upper control piston 51 is mounted. An intermediate control piston 56 is mounted a substantial distance below upper control piston 51 FIG. 14A. A third or lower control piston 58 is moutned below the intermediate control piston 56 near the upper end of the lower spool component 48 as shown in FIG. 3A. The lower end of the lower spool component 48 is provided with an accumulator piston 52 which is connected to piston 58 by rod 46 having an outer surface 46'. Accumulator piston 52 is of less diameter than pistons 56, 58 in order that the O-ring seals on the piston will not be cut or damaged during assembly of the device by contact with the various ports provided in the wall of axial bore 40 which is larger than bore 40 in which piston 52 is mounted. The upper control piston 51 is provided with a hydrostatic balanced O-ring seal 54 engagable with the bore 40. Control pistons 56 and 58 also have cast iron piston ring seals 104 engageable with the bore 40 in an obvious manner as illustrate in FIG. 3A. Accumulator piston 52 is provided with a nitrogen sealing O-ring 60 which seals between nitrogen stored in a chamber defined by cylinder bores 40', 70, and 72 and working fluid flowing in chamber 71.

It should also be observed that the upper spool component 44 includes an axial bore 62 extending downwardly from its uppermost end and terminating in a radial bore 64 provided in a reduced diameter rod portion 45 below intermediate control piston 56 and above the lower control piston 58 of the lower spool component 48 as shown in FIG. 3A. Thus, it should be observed that the space or chamber 66 between control piston 56 and control piston 58 external of the surface of the spool piston assembly 44, 48 and internal of the cylindrical bore 40 comprises an intermediate movable chamber the purpose of which will become apparent hereinafter. It should be noted that pistons 56 and 58 are each provided with three cast iron piston ring seals 104 which are much more resistant to the high pressure and high velocity of the fluid they are subjected to when moving past parts such as bores 94D and 92C than are other types of conventional ring seals which are quickly destroyed and are not satisfactory. Similarly, an upper movable chamber 67 is provided between the surface of bore 40, rod surface 50' and pistons 51 and 56 and a lower movable chamber 71 is provided between the surface of bore 40, rod surface 46' and pistons 58 and 52 as shown in FIGS. 3A and 3B. Piston 52 is provided with pressed or brass sleeves 52' and 52''.

The lower end of bore 40 communicates with the upper end of reduced diameter bore 40' at an annular shoulder 41 with bore 40' communicating on its lowermost end with a even smaller axial bore 70 as best shown in FIG. 3B. Bore 70 at its lower end terminates at a bore 72 and a nitrogen fill valve V (FIG. 3C) is mounted adjacent the lower end of bore 72. Bores 72, 70 and 40' cooperate with accumulator piston 52 to define a nitrogen accumulator which is filled with high pressure nitrogen through valve V prior to placing the apparatus in the casing through valve V.

Figure 3C:
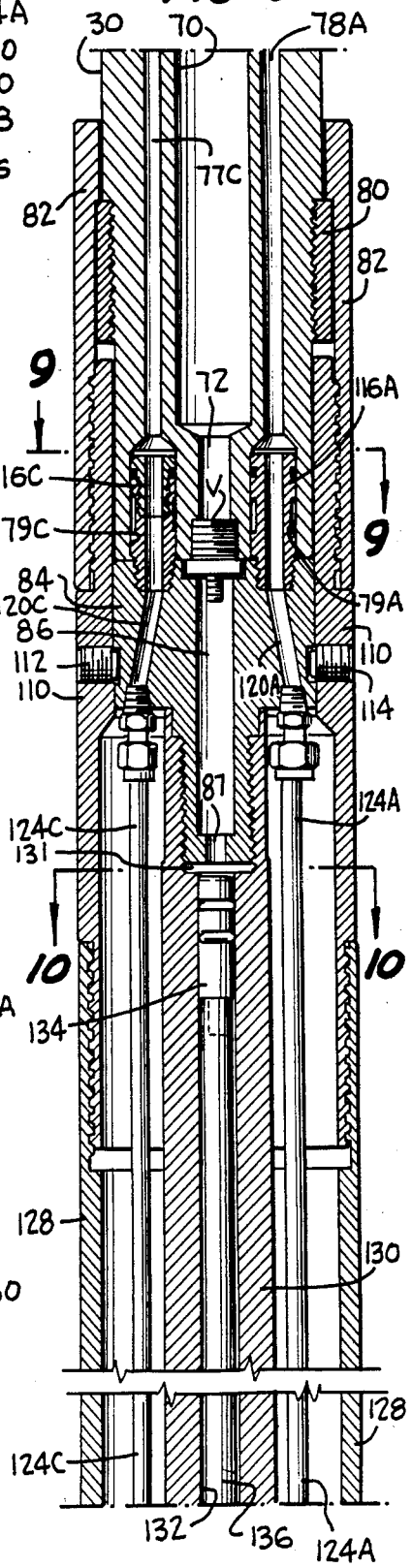
Figure 4:
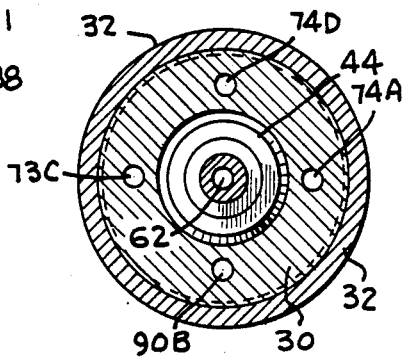
FIG. 4 is a sectional view taken along lines 4—4 of FIG. 3A.

Control housing 30 additionally includes bores 73C and 74A which extend from the upper end of the main control housing 30 parallel to the axis of the housing downwardly to terminate at radial bores 75C and 76A respectively as shown in FIGS. 3A and 3B. An axially parallel bore 77C extends downwardly from the innermost end of radial bore 75C and a similar axially parallel bore 78A extends downwardly from the innermost end of radial bore 76A. Axially parallel bores 88D and 90B (FIGS. 4 and 5) also extend downwardly from the upper end of the main control housing 30 and are similarly respectively connected to radial bores 97D and 98B (FIG. 8) from which axially parallel bores 89D and 91B respectively extend downwardly. The lowermost end of bore 77C communicates with a larger diameter female socket bore 79C (FIGS. 3C and 9) in which a male coupling member 116C is positioned while the lower end of the axially parallel bore 78A communicates with a female socket bore 79A in which a male coupling member 116A is positioned. Male coupling members 116A and 116C have their lower or base ends threaded into threaded openings in the upper end of an upper connector sub 84 in the upper end of the lance section as shown in FIG. 3C. Similarly, the lower ends of bores 89D and 91B respectively communicate on their lower ends with female socket bores 79D and 79B which are dimensioned to receive male coupling members 116D and 116B which are also mounted on the upper end of connector sub 84 of the lance section. The use of the male couplers and female sockets provides a sure quick-coupling and leak-proof connection between the hydraulic circuits of the different sections of the apparatus with the use of O-rings or lip type seals on male coupling members 116A-D. A very substantial advantage arises from the fact that one section of the tool can be easily replaced in the field without a complete disassembly of the tool being necessary. Stated differently, the sections are simply disconnected and the new section easily substituted and the apparatus sections reconnected in an easy manner. During testing and operation of the device, if one section malfunctions, it can consequently be easily replaced with a minimum of difficulty. Also, transportation of the tool is much easier than was possible with the device of U.S. Pat. No. 4,640,362 since the longest component section is only 20 feet as compared to an overall length of 49 feet of the unitary assembly of the aforementioned patent.

Figure 5:
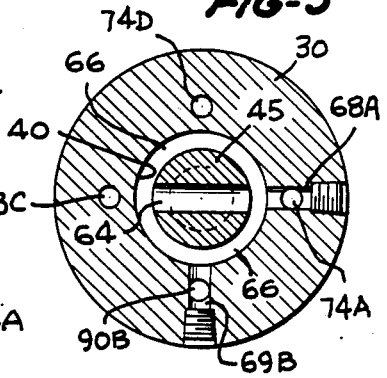
FIG. 5 is a sectional view taken along lines 5—5 of FIG. 3A.

A radial bore 68A provides communication between bore 40 and bore 74A as shown in FIG. 5. Consequently, space 66 and axially parallel bore 74A communicate when the parts are positioned as shown in FIGS. 3A and 5. Similarly, a radial bore 69B provides communication between axially parallel bore 90B and bore 40 and chamber 66 as also shown in FIG. 5.

Figure 7:
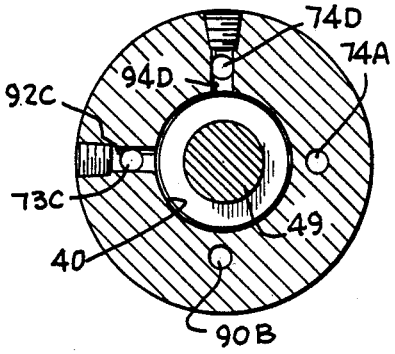
FIG. 7 is a sectional view taken along lines 7—7 of FIG. 3A.

It should also be noted that a radial bore 92C communicates bore 40 with bore 73C as shown in FIGS. 3A and 7 so that space 71 between bore 40, the lower end of piston 58 and the upper end of piston 52 communicates with bore 73C when the parts are in the position shown in FIG. 3A. Additionally, a radial bore 94D communicates the axially parallel bore 88D with the interior of main bore 40 as shown in FIG. 7.

Figure 6:
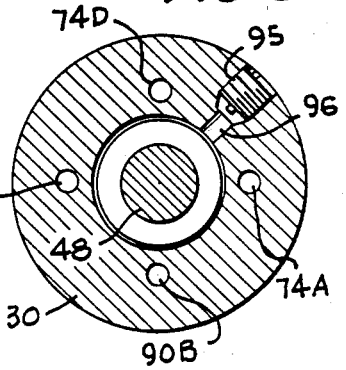
FIG. 6 is a sectional view taken along lines 6—6 of FIG. 3B.
Figure 8:
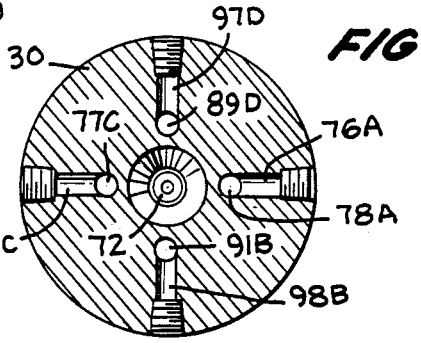
FIG. 8 is a sectional view taken along lines 8—8 of FIG. 3B.
Figure 9:
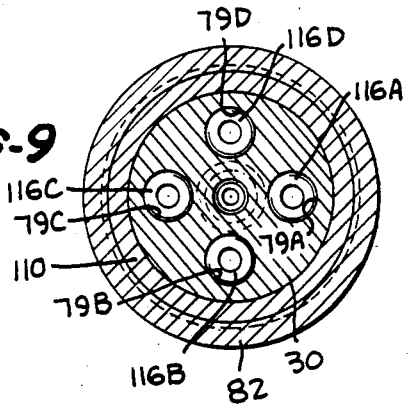
FIG. 9 is a sectional view taken along lines 9—9 of FIG. 3C.

A lower check valve 95 is placed in the outer end of a radial lower vent bore 96 communicating with the interior of bore 40 as shown in FIG. 6 and an upper check valve is placed in an upper vent bore 100 as shown in FIG. 3A. Lower vent bore 96 communicates with chamber 71 and upper vent bore 100 communicates with chamber 67 when spool piston assembly 44, 48 is in its upper position (FIG. 3B). Similarly, radial bores 97D and 98B communicate with axially parallel bores 89D and 91B respectively as shown in FIG. 8. The lower ends of axially parallel bores 88D and 90B communicate with enlarged female socket bores 79D and 79B respectively which are provided for receiving male fluid connector members 116D and (FIG. 9) attached to the upper end of the lance section as previously noted. Different sizes of male and female couplers can be used to insure that the sections can only be connected in a proper manner.

The lower end of the main control housing 30 is connected to the upper end of the lance section by a backup ring 80 (FIG. 3C) threaded onto the outer surface of main control cylinder housing 30 and a coupling sleeve 82 connected at its lower end to a heavy threaded connector sleeve 110. Coupling sleeve 82 is fitted over the backup ring 80 so that members 80 and 82 abut to preclude any additional downward movement of coupling sleeve 82. It should be understood that the term "lance" is used to refer to the semi-rigid extendable conduit and nozzle extension device member 166 and its associated actuating means; thus, "lance" and "semi-rigid extendable conduit and nozzle extension device" are sometimes used changeably.

Turning now to the specifics of the lance section, attention is initially invited to FIG. 3C which illustrates that the upper outer periphery of the lance section is defined by the heavy threaded connector sleeve 110 having external threads at its upper end threadably engaged with the coupling sleeve 82 and enclosing the upper connector sub 84. The aforementioned upper connector sub 84 includes an axial bore 86 and a first pair of diameterically opposite slots which receive locking lugs 112 and 114 mounted in threaded bores in the wall of the connector sleeve 110 as shown in FIG. 3C. Male flow connectors 116C and 116A extend upwardly from the upper end of upper connector sub 84 and have their upper ends in communication with the lower ends of bores 77C and 78A respectively formed in the lower end of control housing 30 with their lower ends being in communication with canted bores 120C and 120A which are in turn respectively connected through fittings to axially parallel conduits 124C and 124A which extend downwardly in connector sleeve 110 and a tubular lance cylinder housing 128 as shown in FIG. 3C.

Figure 10:
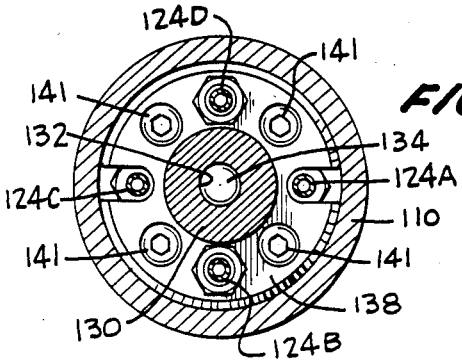
FIG. 10 is a sectional view taken along lines 10—10 of FIG. 3C.
Figure 13A:
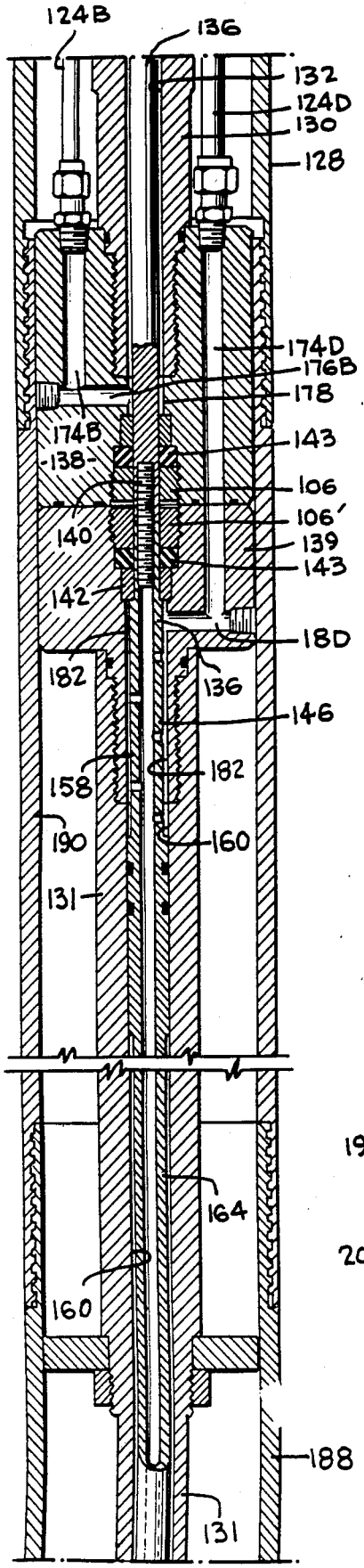
FIG. 13A is a sectional view taken along lines 13A—13A of FIG. 3D.

Similarly, the lower ends of bores 79D and 79B communicate through male coupling members 116D and 116B respectively (FIG. 9) and with canted bores in upper connector sub 84 which in turn communicate with the upper ends of conduits 124D and 124B (FIGS. 10 and 13A).

The tubular lance cylinder housing 128 is threadably mounted on the lower end of the heavy threaded connector sleeve 110 and extends downwardly therefrom. Additionally, an upper lance cylinder 130 is threadably connected to the lower end of the upper connector sub 84 and includes an upper chamber 131' communicating with axial bore 86 of sub 84 via a reduced diameter bore 87 in the lower end of sub 84 shown in FIG. 3C. A lance drive piston 134 is mounted for reciprocation in an axial bore 132 extending downwardly from chamber 131' on the upper end of an upper piston rod component 136 positioned axially in bore 132. Piston 134 is made of monel; however, a stainless steel piston with a brass sleeve has also proven to be satisfactory. It should be observed that there is a clearance between the bore 132 and the rod 136, the purpose of which will become apparent.

Figure 3D:
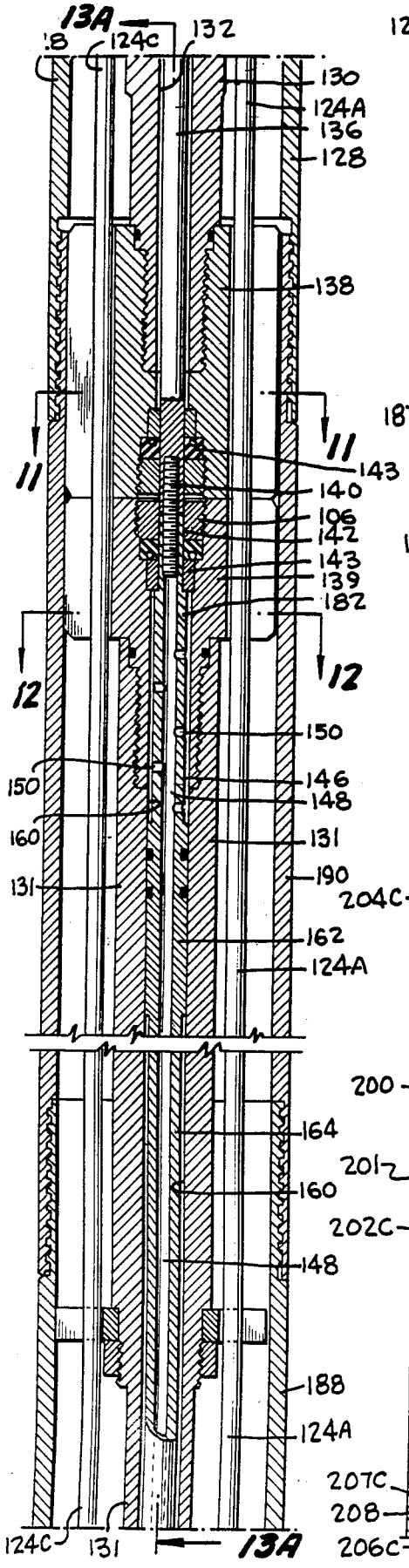
Figure 11:
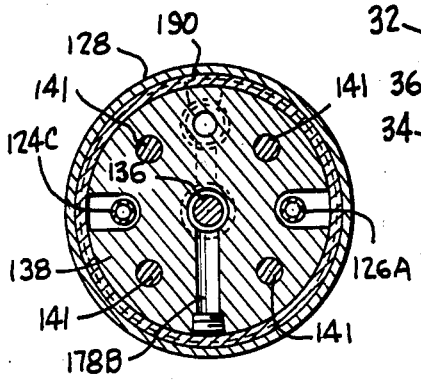
FIG. 11 is a sectional view taken along lines 11—11 of FIG. 3D.
Figure 12:
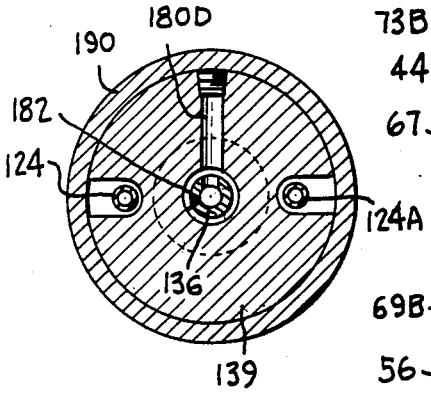
FIG. 12 is a sectional view taken along lines 12—12 of FIG. 3D.
Figure 14A:
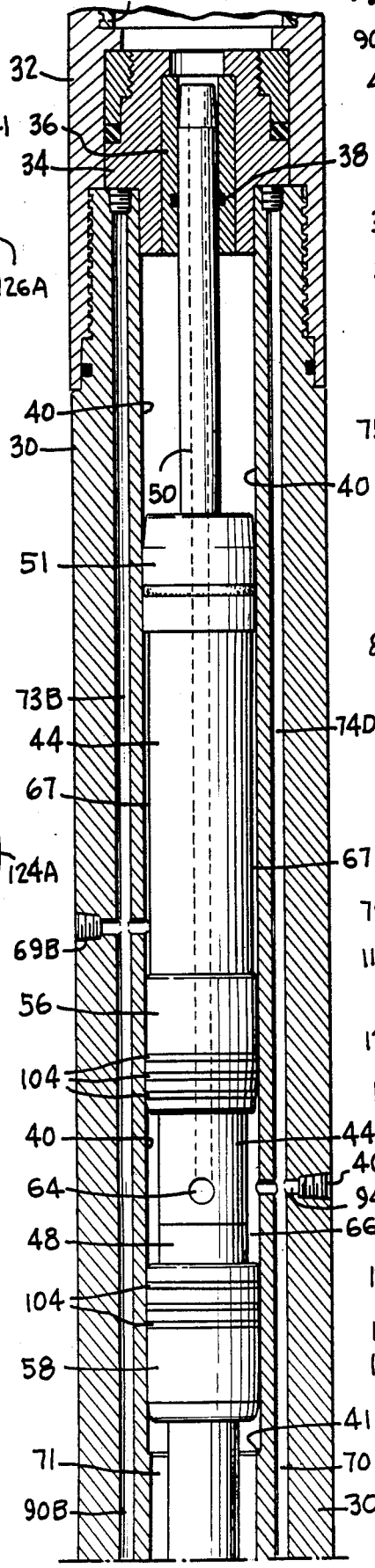
FIGS. 14A, 14B, 14C, 14D, 14E, 14F and 14G are sectional views taken along the same plane as FIGS. 13A etc. but illustrating the parts in a different position in which the penetration has been completed and injection is being performed with the views comprising progressively downward portions of the apparatus from top to bottom.
Figure 14B:
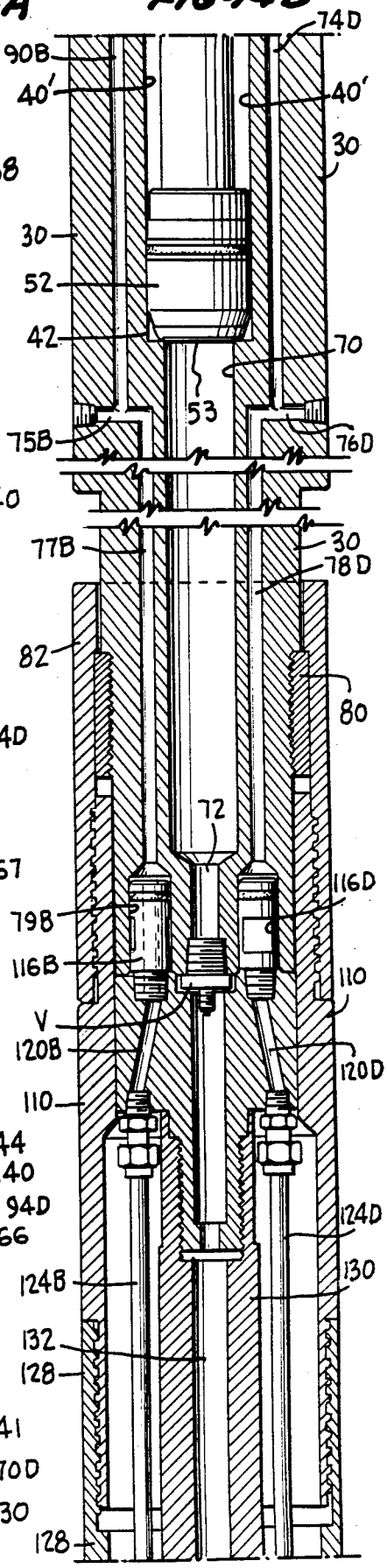

The lower end of upper lance cylinder 130 is threadably received in the upper end of an upper head block component 138 and the lower end of upper piston rod component 136 is threadably connected to the upper end of a threaded rod connector 140 as shown in FIG. 3D. A lower lance cylinder 131 has its upper end connected to the lower end of lower head block component 139. Upper head block component 138 is connected to lower head block component 139 by four machine bolts 141 (FIG. 11) to provide a unitary head block assembly. It should also be observed that the head block components 138 and 139 are provided with slots on diametric opposite sides through which the lines 124C and 124A extend.

The upper end 142 of intermediate monel rod component 146 is threaded on the lower end of the threaded rod connector 140. Rod component 146 has a larger diameter than upper end 142 and also has an axial bore 148. Radial bores 150 communicate axial bore 148 with the space 158 inside bore 182 of lower head block component 139 and bore 160 of lower lance cylinder 131 external of rod 146. It is of substantial importance that rod 146 is positioned within bores 182 and 160 which have a greater diameter than the outer diameter of rod 146. Consequently, liquid is free to pass through the radial bores 150 to or from the inner bore 148 and the space 158 (FIG. 18) between bores 182 and 160 and the outer surface of rod 146. However, lip seal members 143 are mounted in the upper and lower head blocks 138 and 139 by bushings 106 and 106' for providing a pressure tight seal between the bore 132 and the bore 160. Seal members 143 can be a lip seal with an O-ring expander of the type sold under the trademark POLY-PAK by Parker Seal Corporation. The lower end of rod 146 is unitarily connected to a lower lance piston 162 which is matingly received within bore 160 for reciprocation therein. The overall design of the reciprocating lance piston drive assembly allows for the piston rod to remain in tension during all operations of the tool. Because of the long stroke and small diameter of the piston, putting it into compressive load would cause buckling of the piston rod. By injecting fluid at the head block assembly 138, 139 etc. the extending and retracting pressure contacts the lower and upper lance pistons 162 and 134 respectively from the rod side of the piston so that the piston rod 136 is always in tension and is never placed under compressive force.

Figure 3E:
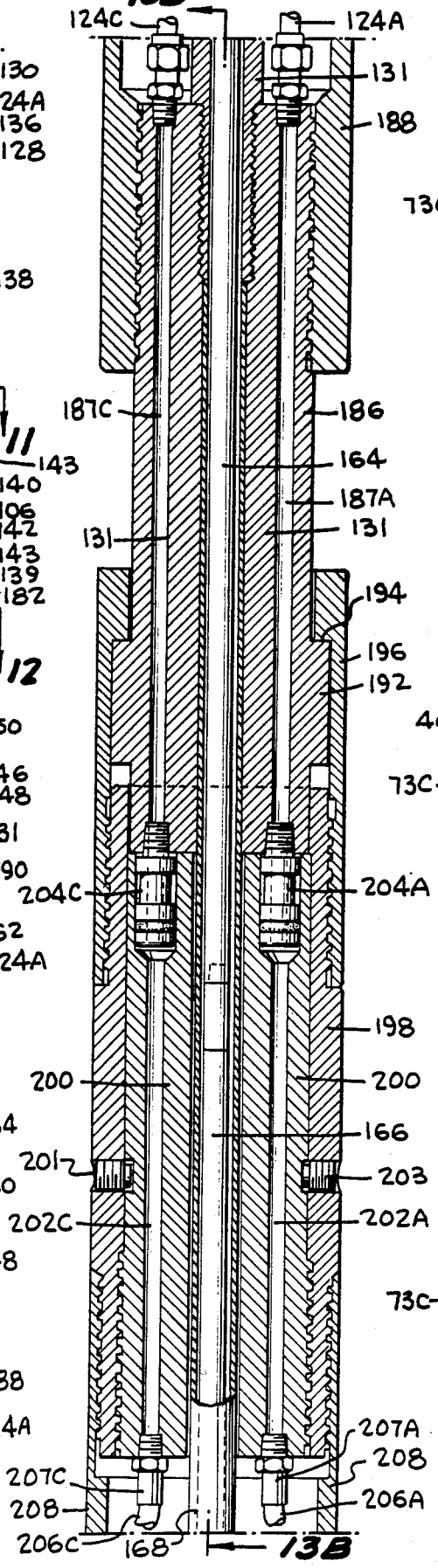

A lance guide 168 receives a lower piston rod 164 which has its lower end connected to the lance 166 formed of a teflon core 272 and outer threaded armored layers 274 of braided stainless steel (FIGS. 3E and 1G). Guide 168 has its lower end connected to a punch base 170 (FIG. 13C) having an internal lance of guide passageway 172. A jet nozzle 169 is connected to the outer end of lance 166 for providing a cutting jet issuing from its outer end when high pressure fluid is provided in lance 166. Lance guide 168 has a small internal clearance of 1/32 inch between its inner surface and the outer surface of rod 164 and lance 166. Similarly, a clearance of approximately 1/32 inch is provided between bore 160 and the outer surface of rod 164. The aforementioned clearances prevent buckling of rod 164 and lance 166 when subjected to compression during extension of the lance in a penetration operation. It should also be noted that the rod portions connecting pistons 34 and 162 are always maintained in tension due to pressure in bores 132 and 182 during operation of the device and are consequently never subjected to compression that might create a problem of buckling.

Figure 13B:
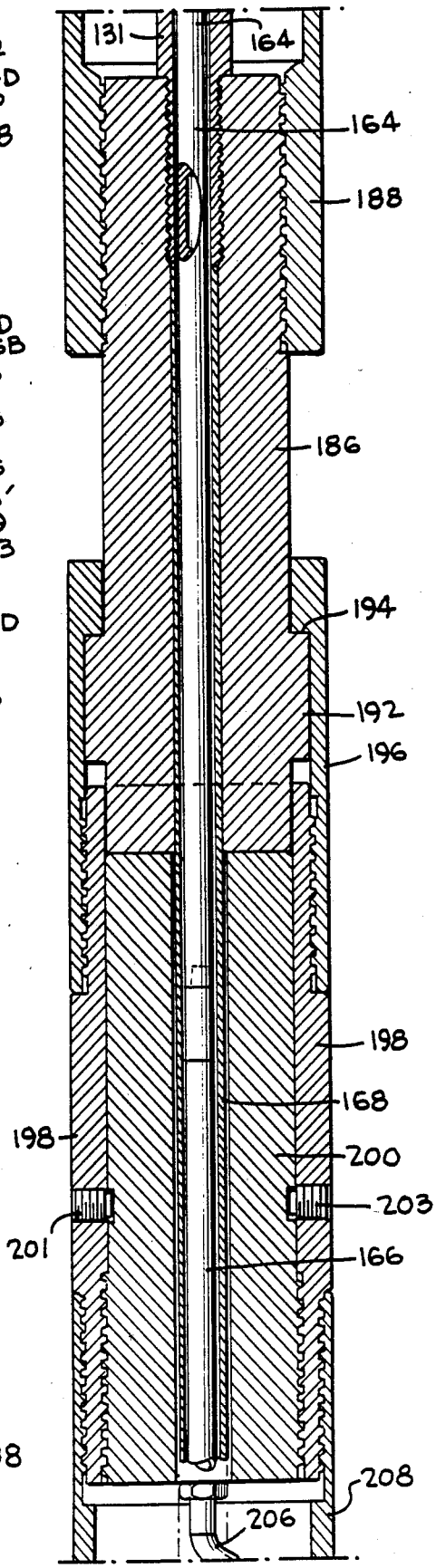
FIG. 13B is a sectional view taken along lines 13B—13B of FIG. 3E.
Figure 13C:
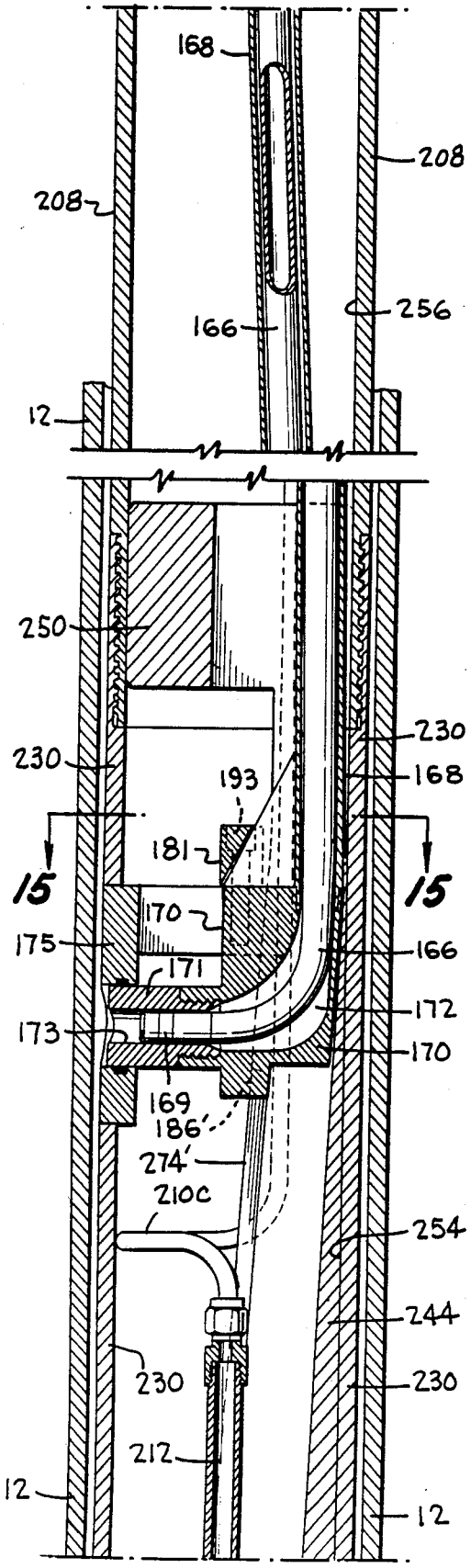
FIG. 13C is a sectional view taken along lines 13C—13C of FIG. 3G.

Punch base 170 has a tubular punch member 171 threaded into one side with the punch having a cylindrical guide bore 173 in which the nozzle 169 is positioned prior to actuation of the device as shown in FIG. 13C. Punch member 171 extends through an opening in a guide 175 of a cam enclosing housing 230 so that the punch member is capable of moving to and from the positions shown in FIGS. 13C and 14F. Movement of punch base 170 is limited to radial movement relative to housing 230 by fixedly positioned guide bars 177 and 179 attached to housing 230 and engaging a cross bar 181 attached to base 170 by bolts 193 and also engaging shoulders 183 and 185 on punch base 170. Longitudinal force from the punch drive piston 236 and punch drive cam 244 is transmitted into radial force through the shoulders 183 and 185 of the punch base to guide bars 177 and 179 and to punch 171 to effect punching of a hole in the casing wall. The combined parts keep the punch aligned with the hole in the guide 175 of cam enclosing housing 230. Crossbar 181 prevents damage to the cam housing 230 by the punch base 170 in the event of the shearing of the punch. The punch base is always maintained in alignment with guide 175. The contacting surfaces of 177, 183 and 179, 185 are hardened to absorb the high pressures and forces to which they are subjected. Punch base 170 additionally includes hardened cam follower surfaces 186 and 189 engagable with hardened cam surfaces 245, 245', 247 and 247' of cam 244 for moving punch base 170 and punch 171 outwardly in response to upward movement of cam 244. Similarly, follower surfaces 191 engage facing surfaces of cam 244 to retract the punch 171 in response to downward movement of cam 244. The construction and interaction of the punch and cam 244, etc., is similar to that disclosed in Schellstede U.S. Pat. No. 4,640,362; however, the punch employs arcuate side slots 264 (FIG. 3F) as opposed to the rectangular slots 254 of the Schellstede patent; also the control circuitry is substantially different. The outer surface of the punch is hardened and it is machined so that its vertical cutting edges E is always vertical, the ratio of the outer diameter to the inner diameter of the punch must be such that the hole punched in the casing does not produce a plug punched out of the casing into the middle of the punch. The inner diameter edge of the punch is radiused to resist cutting of such a plug. Also, the angle of the punch surfaces are to be 45 degrees from the horizontal axis.

The lower ends of conduits 124B and 124D respectively communicate with axially parallel bores 174B and 174D as shown in FIG. 13A. Conduit 174B in turn communicates with a radial bore 176B which has its inner end communicating with an axial bore 178 through which the lower end of rod 136 extends with there being a clearance between bore 178 and the outer surface of rod 136. Consequently, radial bore 176B is in fluid communication with the space between bore 132 and the outer surface of rod 136 by virtue of the communication of bore 178 with bore 132 as shown in FIG. 13A. Similarly, the lower end of axially parallel bore 174D is connected to a radial bore 180D having an inner end communicating with a bore 182 surrounding and spaced from the upper end 142 of rod 146 as shown in FIG. 18.

Figure 18:
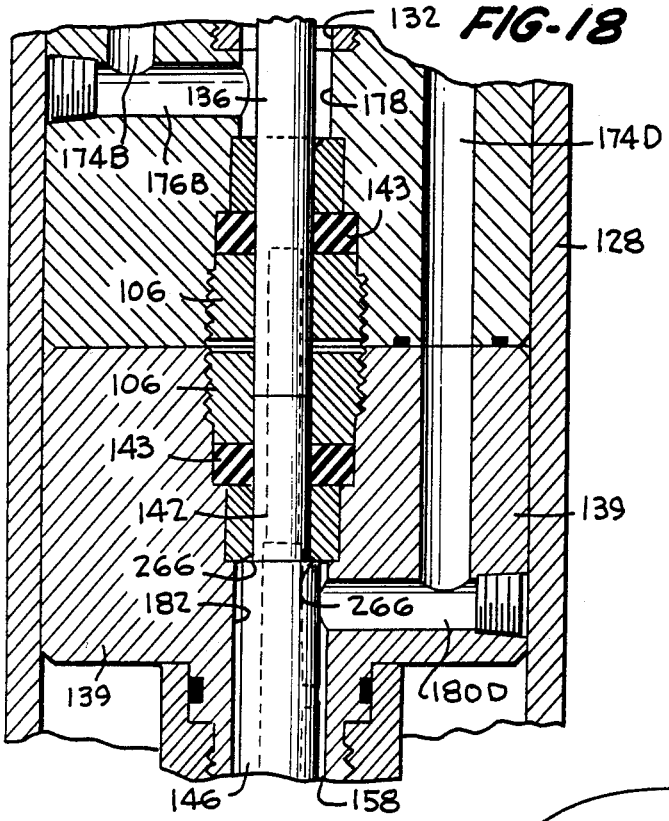
FIG. 18 is an enlarged view of a portion of FIG. 13A.

The upper end of bore 182 terminates at an annular seat surface 266 against which the upper end of rod component 146 is engaged when the parts are in the positions illustrated in FIGS. 3D and 18. However, when the parts are in the position illustrated in FIG. 14C, radial bore 180D is placed in full communication with the space between bore 182 and the outer surface of rod 136. The lower end of the lower lance cylinder 131 is threadably received in an axial threaded socket in the upper end of a rigid lance carrier block 186 in which axially parallel bores 187C and 187A are respectively provided in alignment with conduits 124C and 124A as shown in FIG. 3E.

Additionally, it should be noted that the upper external periphery of the lance carrier block 186 is threadably received in the lower end of a tubular housing 188 (FIG. 3E). The upper end of tubular housing 188 is threadably received in the lower end of an intermediate tubular lance housing 190 which has an upper end threadably received in the lower end of the upper tubular lance housing 128. An annular flange 192 (FIG. 3E) extends outwardly from the lance carrier block 186 and provides a shoulder 194 engaged with a facing shoulder of a threaded tubular connector 196 which is in turn threaded onto the upper end of a punch cam housing 198.

Figure 3F:
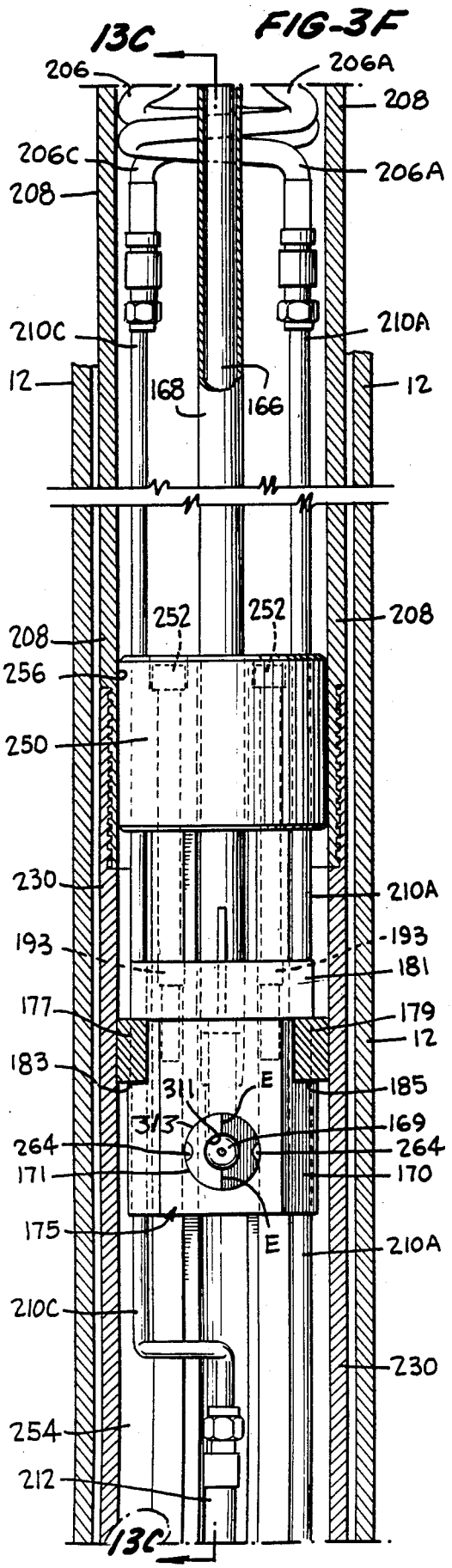

A lower lance carrier block 200 is threaded internally of the housing 198 with the lance guide tube 168 extending from carrier block 200 and with threaded lugs 201 and 203 holding block 200 in position as shown in FIG. 3E and similarly in FIG. 13B. Axially parallel bores 202C and 202A (FIG. 3E) extend along the length of lance carrier block 200 and communicate at their upper ends with bores 187C and 187A respectively through male connector members 204C and 204A mounted in the lower end of the lance carrier block 186. Additionally, flexible hose members 206A and 206C are respectively connected by coupling fittings 207A and 207C to the lower ends of bores 202A and 202C and extend downwardly in the wedge travel housing 208 threaded onto the lower end of the punch cam housing 198. Similarly, hose members 206C and 206A are connected at their lowermost ends to fixedly positioned conduits 210C and 210A as shown in FIG. 3F.

Figure 3G:
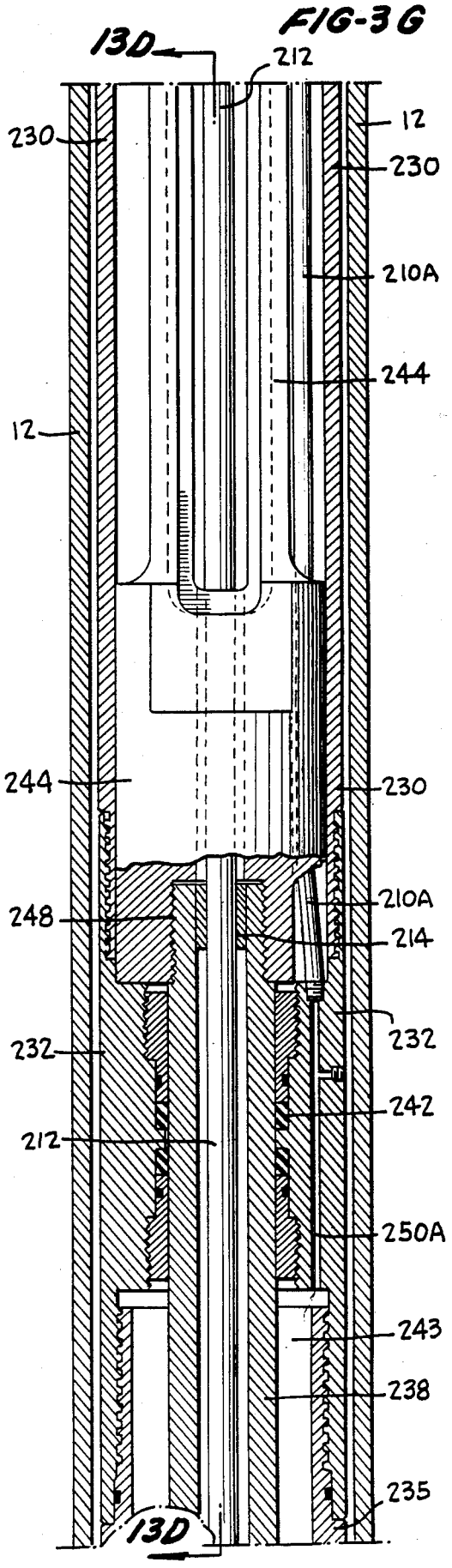

The lower end of conduit 210C is connected to a fixedly positioed hollow rod 212 extending through a cam enclosing housing 230 which extends downwardly from the lower end of housing 208. A rod guide head block 232 (FIG. 3G) is threaded on the lower end of housing 230 and a punch cam drive cylinder 235 is threaded to the head block 232 as shown in FIG. 3G.

Figure 13D:
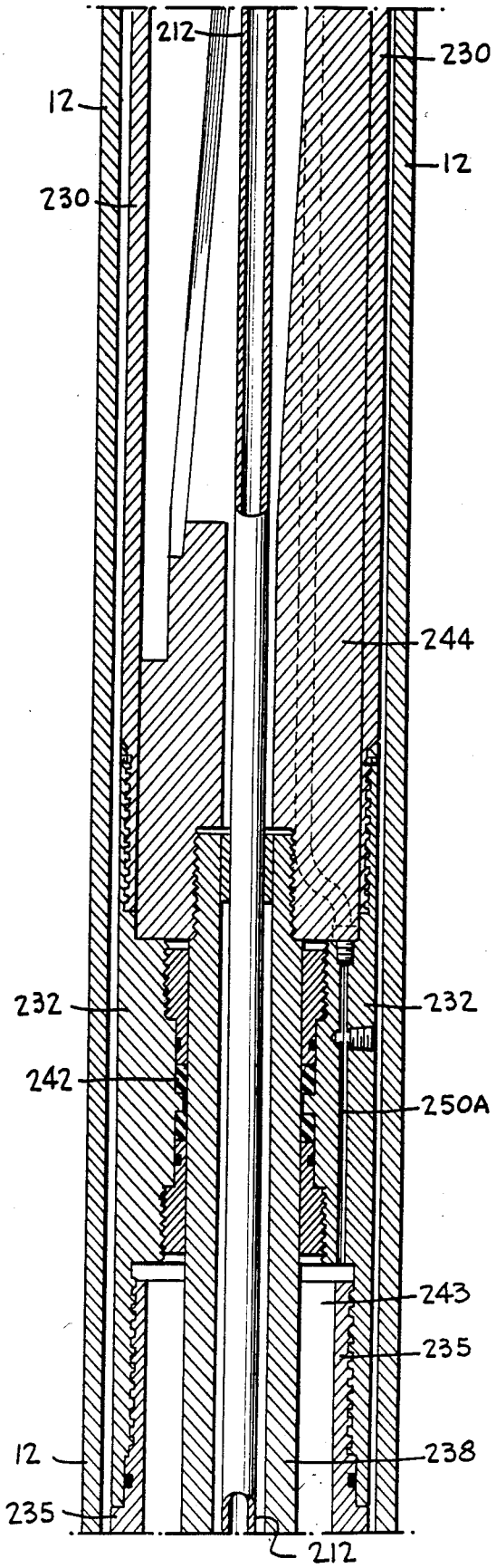
FIG. 13D is a sectional view taken along lines 13C—13C of FIG. 3F.

A punch drive piston 236 is mounted for reciprocation on the interior of cylinder 235 and includes an axial aperture through which the hollow rod 212 extends. It should be understood that piston 236 can reciprocate relative to rod 212 and that leakage from one side of the piston to the other side of the piston is precluded by virtue of seal means 238 engaging the outer surface of rod 212; also, brass bushings 214 engage rod 212. The aforementioned construction replaces the traveling hoses in the punch section of U.S. Pat. No. 4,640,362 to provide a much more durable and reliable construction. Moreover, assembly of the apparatus is much easier. It should also be observed that the rod 212 is mounted axially in a bore 240 in a punch cam drive rod 238 threaded at its lower end in piston 236 at 246 (FIG. 3H) and threaded at its upper end in punch drive cam 244 at 248 (FIG. 3G). Seal means 242 (FIG. 13D) in head block 232 engages rod 238 to prevent pressure leakage from the rod side chamber 243 of cylinder 235; also, a bore 250A (FIG. 3G) extends through head block 232 and has its lower end connected to rod side chamber 243 with its upper end being connected to the lower end of conduit 210A. A cam guide block 250 is attached to the upper end of cam 244 by machine bolts 252 and slidingly engages the bores 254 and 256 respectively of housings 230 and 208. Guide block 250 assists the wedge in maintaining alignment during movement in either direction in preventing the wedge from cocking or lifting up off of cam enclosing housing 230 during retraction of the punch.

A cycle of operation will now be discussed with initial reference being made to FIGS. 2 and 3A through 3H. Prior to lowering of the tool down the hole, the accumulator which is generally designated 260 and which comprises the space within bores 70, 73 and 43' is charged with nitrogen at a sufficiently high pressure to exert a force on accumulator piston 52 sufficient to overcome the oppositely acting forces caused by the pressure head in tubing section 26 which is conveyed to the interior of main housing 30 via bores 62 and 64. With the parts in the position illustrated in FIGS. 3A through 3H, it will be observed that the pressure in tubing member 26 will pass downwardly through bore 62 and radially through bore 64 into chamber 66 where it acts upwardly and downwardly on pistons 56 and 58; since the upper portion of the piston spool includes bore 62, the area on which the pressure acts upwardly is less than the area on which downward force is exerted, the net effect is that member 44 is urged downwardly. FIGS. 3A and 3B illustrate the fact that the surface area of accumulator piston on 52 is substantially greater than the cross-sectional area of axial bore 62. The area of bore 62 equals the amount that the area of piston 52 exceeds the area of piston 56. Thus, the downward force exerted by the hydrostatic pressure of liquid in the tubing section 26, the hydrostatic pressure times the area bore 62. The upward force necessary to overcome the hydrostatic force is equal to the pressure in the accumulator times the area of piston 52. Since the area of piston 52 is substantially greater than the area of bore 62, the pressure in the accumulator acting on the bottom end of accumulator piston 56 can be consequently substantially less than the hydrostatic pressure to which the upper end of the tool is subjected.

Figure 2:
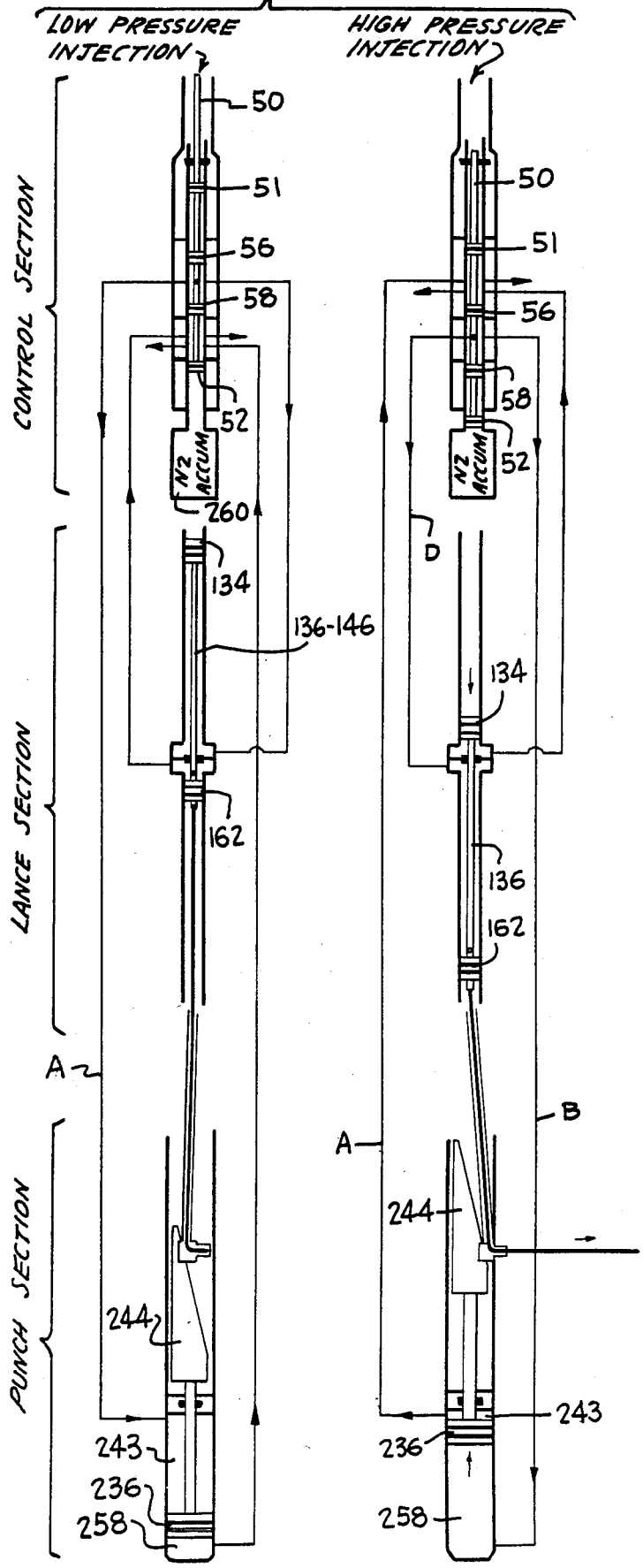
FIG. 2 is a flow diagram illustrating the operation of the hydraulic circuitry and certain mechanical components of the invention.
Figure 3H:
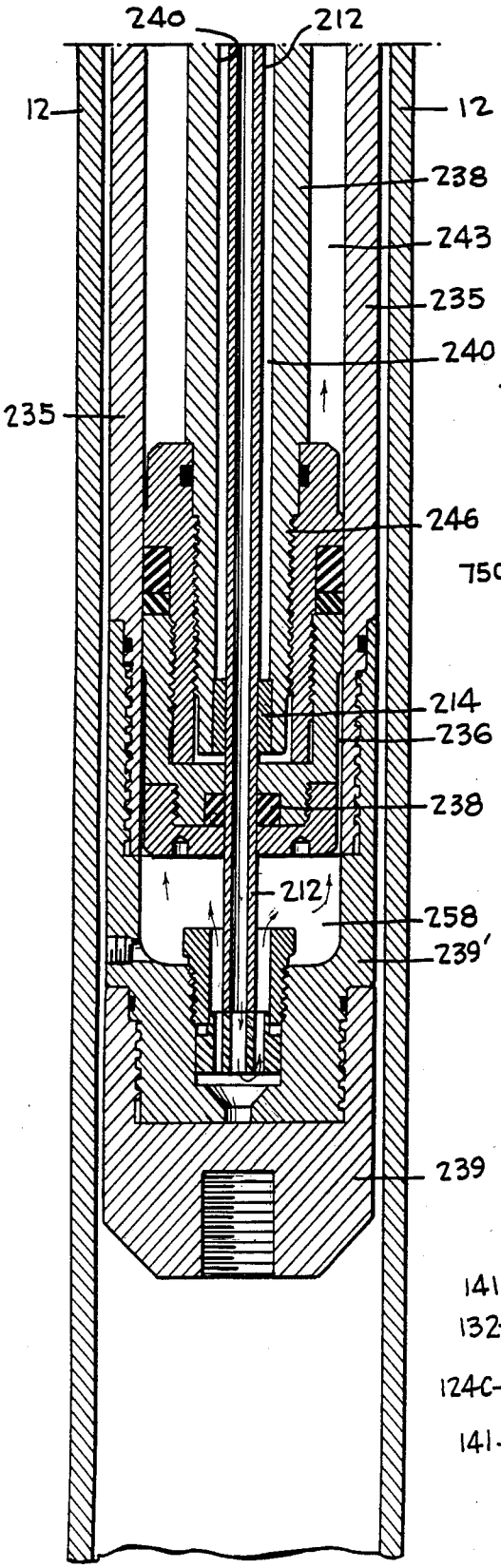

Additionally, the pressure in chamber 66 also passes through radial bore 68A and into vertical bore 74A (FIG. 5), radial bore 76A, vertical bore 78A, male flow connector 116A, canted bore 120A, conduit 124A, bore 187A, connector 204A, bore 202A, fitting 207A, hose 206A, bore 210A, conduit 250A, into rod side chamber 243 so as to hold the punch drive piston 236 in its lower position as shown in FIGS. 2 and 3H. The aforementioned flow path is collectively labelled A in the left portion of FIG. 2. It is significant that pressurized fluid in the movable chamber 66 is also applied to radial bore 69B and conduit 90B in a manner that will be apparent from inspection of FIG. 5. The pressure in conduit 90B is conveyed through 75B, 77B, 116B, 120B, 124B, 174B, 176B (which conduits are collectively labelled B in FIG. 2) to bore 178 from which it flows upwardly between bore 178 and the outer surface of rod 136 into bore 132 (FIG. 18) to act on the lower surface of the lance drive piston 134 to urge the piston upwardly to maintain the rod 164 and lance 166, etc, in their fully retracted position. All of the components consequently remain in the positions illustrated in FIGS. 3A through 3H and FIGS. 13A through 13D. Since the piston ratio of the nitrogen pressure to the hydrostatic pressure is such that the spool piston assembly stays in the up or retracted position, the hydrostatic pressure is used to hold the punch and lance in the retracted positions until pump pressure is applied as an additive force to the hydrostatic pressure to move the spool piston assembly into the down or extended position.

Figure 15:
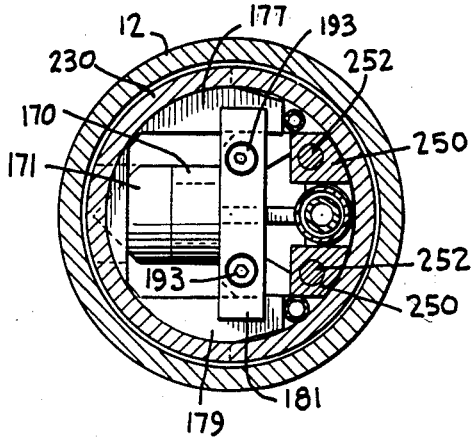
FIG. 15 is a sectional view taken along lines 15—15 of FIG. 13C.
Figure 16:
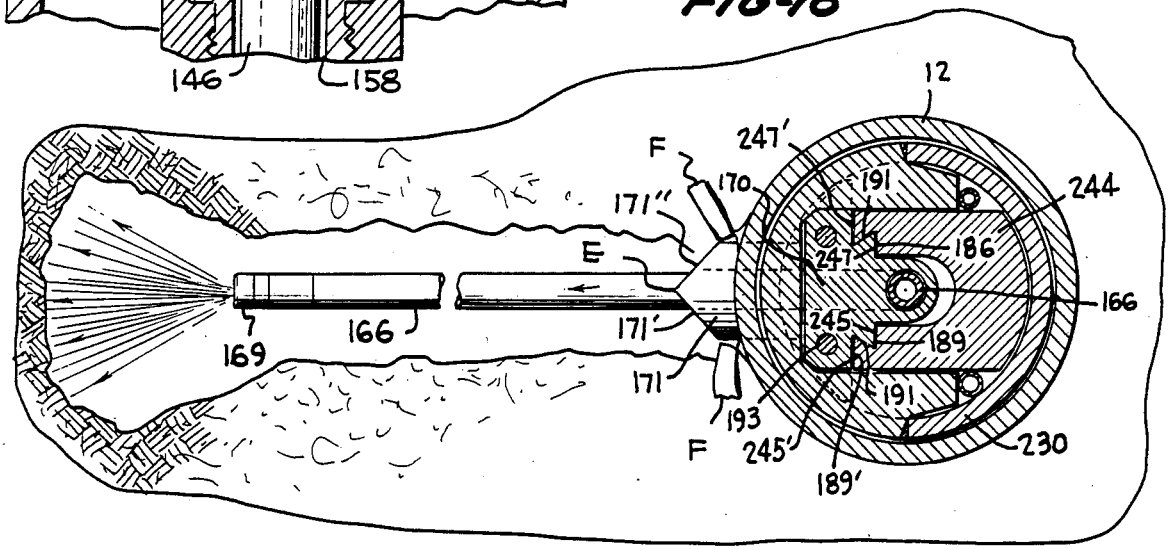
FIG. 16 is a sectional view taken along lines 16—16 of FIG. 14F.
Figure 19:
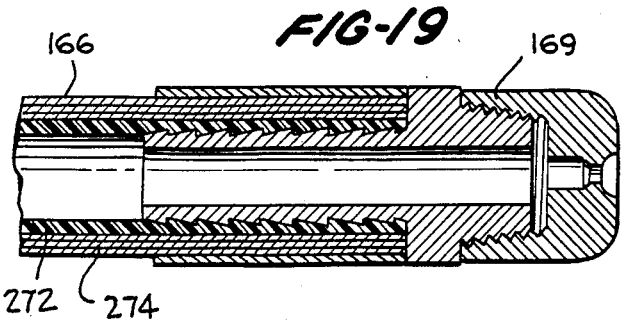
FIG. 19 is a bisecting sectional view of the nozzle employed in the preferred embodiment.
Figure 17:
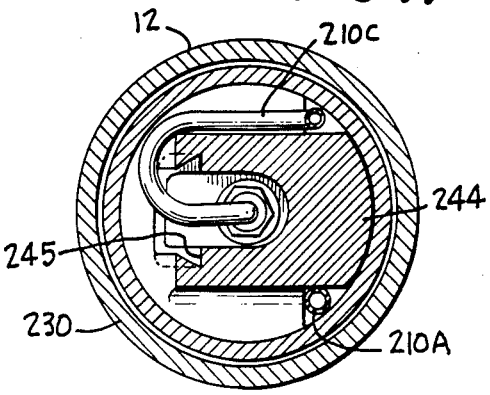
FIG. 17 is a sectional view taken along line 17—17 of FIG. 14F.

When it is desired to begin a penetration operation, the pressure in the tubing member 26 is increased above the critical point necessary to overcome the pressure in the nitrogen accumulator 260. The parts immediately move from the positions illustrated in FIGS. 3A through 3H and 13A through 13D to the positions illustrated in FIGS. 14A through 14E as a consequence of the downward movement of the spool component 46. The initial movement of the spool component results in radial bore 68A being disconnected from the pressure in the movable chamber 66 so that the rod side chamber 243 of punch drive cylinder 235 is vented through bore 250A, conduit 210A, etc., to the interior of bore 40 (Figure 14A) from which it is dumped from the apparatus through check valve 100 (FIG. 3A). The punch drive piston 236 is consequently free to move upwardly to initiate movement of cam 244 and the resultant movement of the punch member outwardly to begin the punching operation. Pressurized fluid for moving the piston 236 flows along path B compressing flow from chamber 66 through bore 92C, bore 73C, bore 75C, bore 77C, bore 79C, male coupling member 116C, canted bore 120C, conduit 124C, bore 187C, coupling 204C, bore 202C, coupling 207C, hose 206C, conduit 210C and hollow rod 212 from the lower end of which it is discharged into the head (or lower) end chamber 258 of the punch drive cylinder to immediately initiate upward movement of piston 236, rod 238 and cam 244. The upward movement of cam 244 causes the cam to move the punch 171 from its retracted position illustrated in FIGS. 13C and 15 outwardly to its extended position illustrated in FIGS. 14F and 16 with such movement effecting the punching of a hole through casing 12 with the displaced portions of the casing solely comprising flaps F (FIG. 16) without there being any disconnection of any portion of the casing from the casing body. The outward movement of the punch 171 is accompanied by movement of nozzle 169 which substantiatly moves outwardly from the nozzle end to cut an opening in the surrounding earth in a manner to be discussed.

Figures 14C, 14D, 14E:
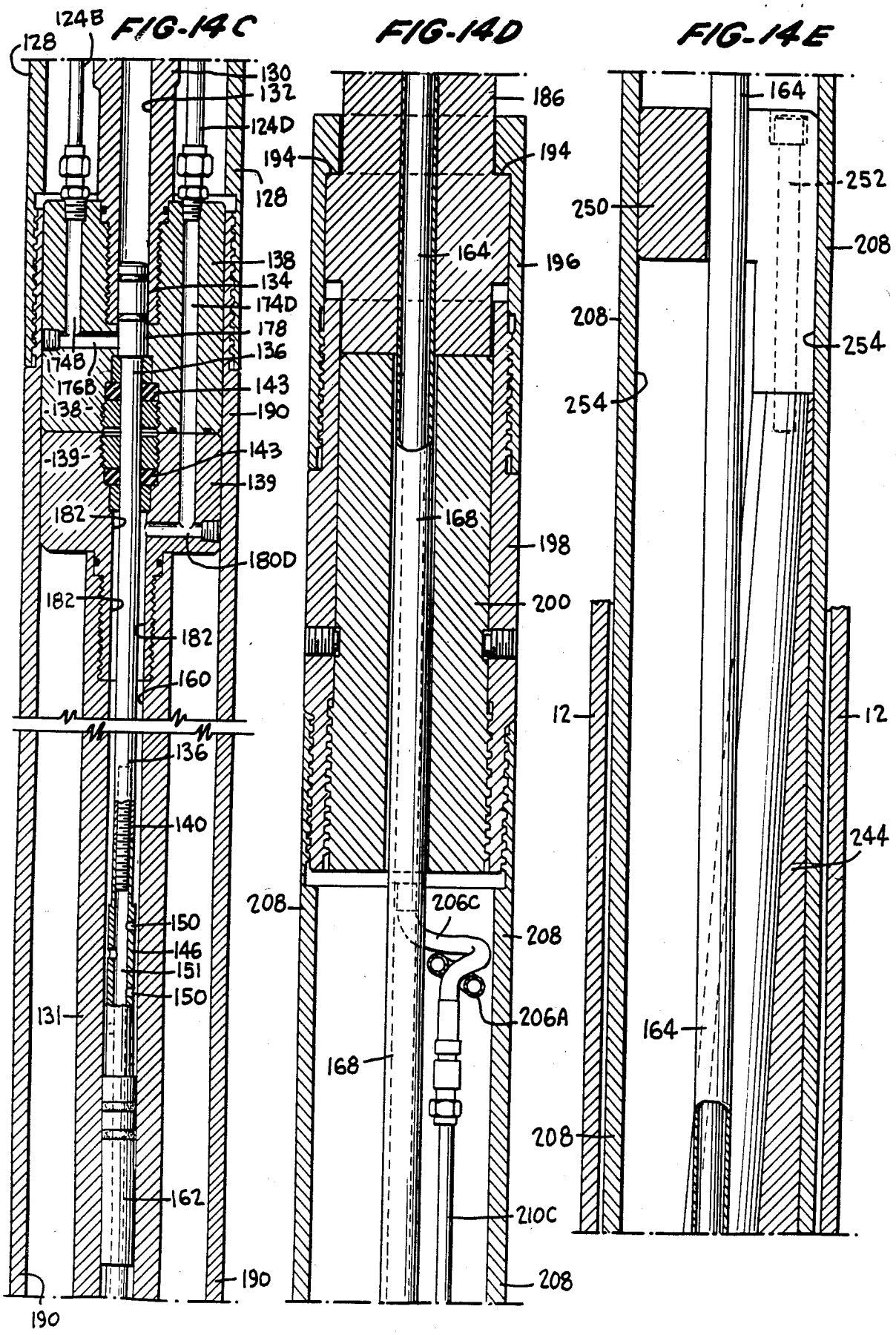
Figure 14F:
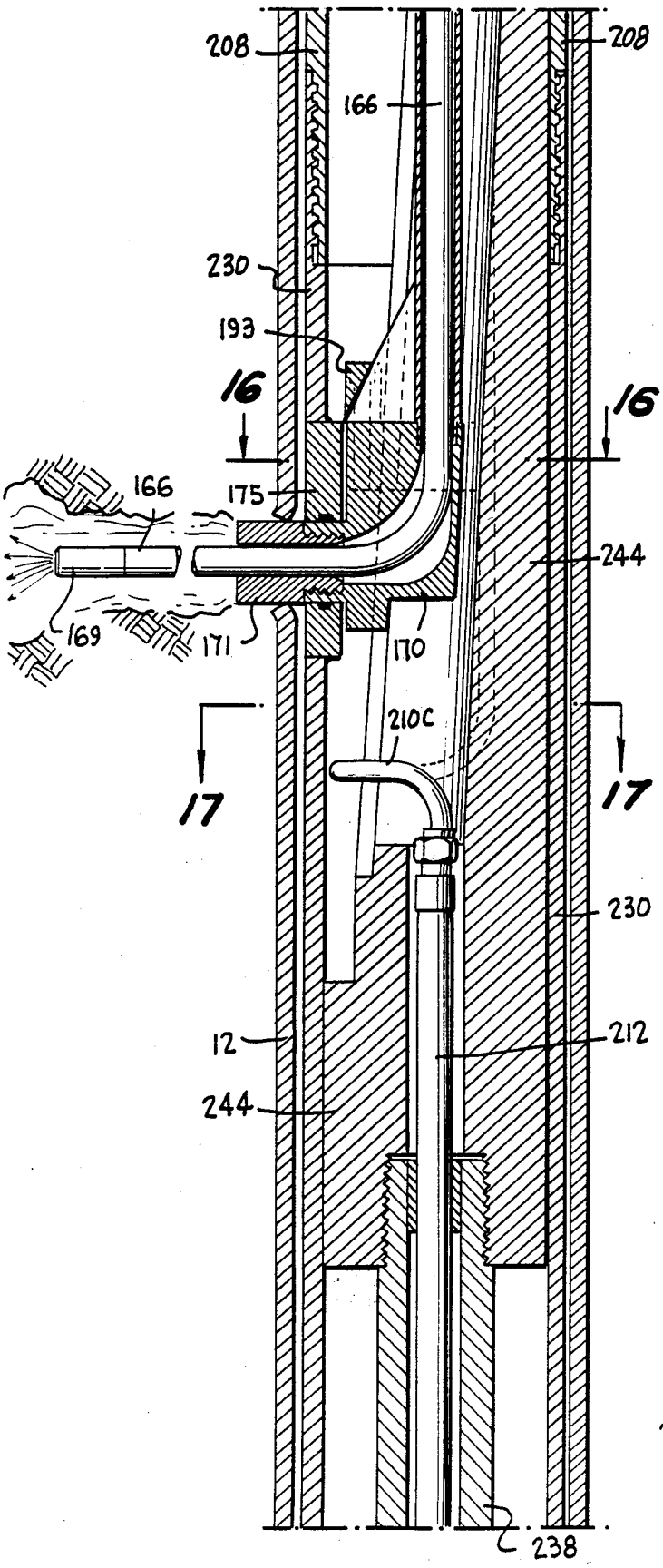
Figure 14G:
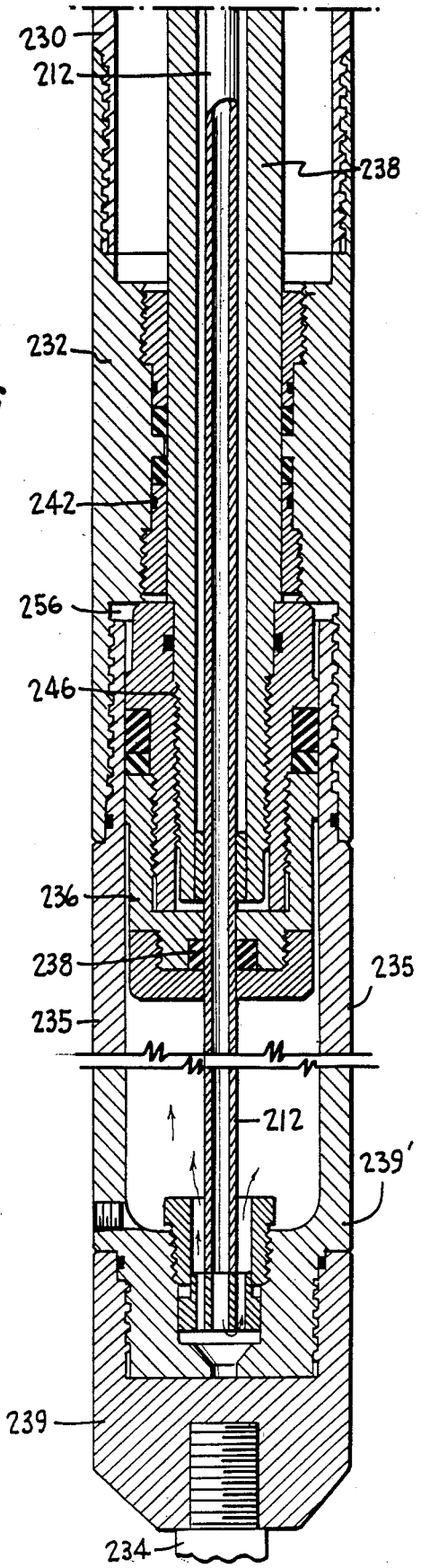

The downward movement of the spool assembly 44, 48 also positions pressurized chamber 66 is alignment with radial bore 94D (FIG. 7) from which the high pressure passes downwardly through bore 74D, radial bore 76D, bore 78D, bore 79D coupling member 116D, canted bore 120D, conduit 124D, bore 174D and radial bore 180D into the bore 160. Fluid is permitted to flow downwardly into the upper end of bore 160 in the space between the bore and the outer surface of rod 136 as well as the space between the outer surface of the intermediate rod component 146 and bore 160 so that the fluid flows through the radial bores 150 into the axial passageway 151 (FIG. 14C). The fluid in passageway 151 flows downwardly into the axial passageway provided in member 162 from the lower end of which it enters the interior of lance 166 to begin the discharge of fluid from nozzle 169 in an obvious manner. The aforementioned composite flow path into bore 160 comprises path D as shown in the right portion of FIG. 2. During penetration of the lance into the earth, the liquid and cuttings flow back past tabs F and through the slots 264 to drop into the annular space between the inner surface of the casing and the outer surface of the tool.

When the penetration is completed, the pump pressure is reduced sufficiently to permit the pressure in accumulator 260 to provide sufficient force on accumulator piston 52 to return the spool member 44,48 to the position illustrated in FIGS. 3A and 3B. Such movement results in the provision of working fluid to radial bore 176B (FIG. 14C) to act on the lower end of piston 134 to retract the lance to the positions illustrated in FIGS. 3C through 3F. The return of spool member 44 to the position illustrated in Figure 3A also permits fluid to flow through path A to effect downward movement of piston 236 and cam 244 to retract punch 171 back into the housing to its FIG. 13C position. The fluid in chamber 258 of cylinder 235 and in bore 160 above piston 162 is exhausted through the lower check valve bleed port to permit the aforementioned movement. The cycle can be repeated a number of times to effect plural penetrations in the same producing zone. Following completion of all penetration operations a weighted rod is dropped down the drill string to break a shear pin in circulating valve 21 to permit the tubing string to be drained of all fluid so as to reduce the amount of force required to lift the string and the penetration apparatus upwardly from the well casing and to eliminate pulling a "wet string" of tubing which would flood the well site.

Components 36, 51, 56, 58 and 236 are made of brass. All of the housing components are made of 4140 alloy steel; punch 171 is made of 5—5 tool steel and remaining metal components are stainless steel.

Another significant aspect of the invention resides in the fact that the punch faces 171' and 171'' are perpendicular to each other. Also, the ratio of the outer diameter of the punch to the inner diameter should not be less than 2.3 in order to obtain an opening in which flaps F of the casing are folded back along opposite sides of the opening. If a ratio less than approximately 2.3 is used, the center bore will simply cut out a "biscuit" that will remain in the bore of the punch and preclude extension of the nozzle and/or break the punch. Avoidance of the cutting of a "biscuit" from the casing is additionally made more likely by the fact that the intersection of the outer end of the internal bore with the punch faces is a rounded edge 311 while the outer diameter intersection 313 is a sharp edge. Rounded edge 311 also aids in centering the lance to ensure that the lance will be retracted completely inside the punch.

The preferred embodiment is sufficiently small to permit its use in 4½ inch O.D. casings, the smallest used in oil and gas wells. Prior known devices of the type disclosed in U.S. Pat. No. 4,640,362 could not be used in such small casing.

Numerous modifications of the preferred embodiment will undoubtedly occur to those of skill in the art. Therefore, it should be understood that the spirit and scope of the invention is to be limited solely to the appended claims.

I claim:

1. In a well penetrator of the type including a housing means, a working fluid input means in said housing means, an outwardly movable punch member having an inner end and an outer end, said outer end including casing cutting means for cutting an opening in a casing when moved forcefully against such casing, means supporting said punch member for movement relative to said housing means between a retracted position in which said outer end of said punch member is positioned substantially within the confines of said housing means and an extended position in which said outer end of said punch member is positioned outwardly of said housing means, power actuated punch drive means mounted in said housing means for moving said punch member between its retracted and extended positions, high pressure lance means having nozzle means mounted on one end for movement in said punch member between a retracted position in which said nozzle means is positioned internally of said punch member and an extended position in which said nozzle means is positioned externally of said punch member for discharging a high pressure jet outwardly beyond the outer end of said punch member for cutting and removing the surrounding earth formation, nozzle positioning drive means mounted in said housing means for moving said nozzle toward its extended position and for retracting said nozzle toward its retracted position, the improvement comprising control means mounted in said housing means responsive to the input of working fluid at a pressure above a predetermined pressure for substantially simultaneously actuating said punch drive means and said nozzle positioning drive means to effect substantially simultaneously the initiation of movement of said punch means and said nozzle means from their retracted positions toward their extended positions.

2. The apparatus of claim 1 wherein said control means additionally, includes means for providing pressurized working fluid to said lance means substantially simultaneously with the actuation of said punch drive means and said nozzle positioning drive means.

3. The invention of claim 2 wherein said control means includes control cylinder means, a pressure accumulator containing pressurized gas, an accumulator piston mounted for reciprocation in a cylindrical bore in said accumulator between a first position and a second position with the pressurized gas in said pressure accumulator tending to move the accumulator piston toward said first position, control rod means having an open interior and extending from said accumulator piston through said control cylinder means, a plurality of control pistons mounted on said control rod means in said control cylinder means and a hollow rod extension communicating the open interior of said control rod means with said source of working fluid so that the pressure of the working fluid exerts a force on said control rod means opposite the force exerted by the pressurized gas in said accumulator so that the accumulator piston is shifted to its second position when the source of working fluid is at a pressure equal to or greater than a predetermined critical pressure.

4. The invention of claim 3 wherein said control pistons comprise an upper control piston, an intermediate control piston and a lower control piston and bore means for communicating said interior of said control rod means with a movable chamber defined by the exterior surface of said control rod means, the surface of said control cylinder and facing end surfaces of two of said control pistons.

5. The apparatus of claim 3 wherein the outer end of said movable punch member comprises two substantially planar surfaces intersecting along a transverse line extending substantially perpendicularly to a longitudinal axis of said punch member and wherein said punch member additionally includes a cuttings removal passageway comprising a pair of arcuate grooves each respectively extending along the outer surface of opposite sides said punch member for conveying earth cuttings resultant from the operation of said nozzle means into said casing.

6. A method of penetrating a well casing and surrounding earth strata comprising the steps of:

(a) positioning a punch member internally of the casing at a desired depth in alignment with strata desired to be penetrated; and (b) forcing said punch member outwardly through the casing to an extended position to effect the provision of an aperture in the casing while simultaneously moving a jet nozzle means outwardly through said punch member while concurrently providing a high pressure liquid jet from said nozzle means to effect the application of force to the casing to weaken the casing and aid the operation of the punch in cutting the casing and surrounding strata.

7. A well penetrator of the type including a housing means, a source of pressurized working fluid provided in said housing means, selectively operable control means connected to said source of pressurized working fluid, an outwardly movable punch member having an inner end and an outer end and being mounted for axial movement between a retracted position in which said punch member is fully enclosed within said housing means and an extended position in which the outer end of said punch member extends outwardly of said housing means a sufficient distance to cut through a well casing in which the housing means is positioned, wedge cam means mounted in said housing means for reciprocation, camming surface means on said wedge cam means, cam follower means engaging said camming surface means and connected to said punch member so that axial movement of said wedge cam means extends or retracts said punch member relative to said housing means, hydraulic cylinder means, a piston and rod assembly mounted for movement in said hydraulic cylinder means, means connecting said piston and rod assembly to said wedge cam means and wherein said wedge cam means is mounted between said hydraulic cylinder and said source of pressurized working fluid and further including conduit means fixedly connected on an upper end to said control means and having a lower fixedly positioned conduit portion extending axially through said wedge cam means so that said wedge cam means is moveable relative to said lower fixedly positioned conduit portion which is connected in communication with said hydraulic cylinder means and wherein said control means includes means for connecting said source of pressurized working fluid to said conduit means or for alternatively connecting said conduit means to exhaust for effecting movement of said piston and rod assembly and said wedge cam means.

8. The well penetrator of claim 7 wherein said piston and rod assembly includes an axial bore through which said lower conduit portion of said conduit means extends so that said piston and rod assembly reciprocates relative to said conduit means.

9. The well penetrator of claim 8 wherein said control means includes:

(a) a control housing forming part of said housing;

(b) an upper cylindrical bore in said control housing and having upper and lower ends;

(c) a lower reduced diameter cylindrical bore coaxially adjacent to the lower end of said upper cylindrical bore but having a smaller diameter than said upper cylindrical bore;

(d) spool means mounted for reciprocation between first and second positions in said upper and lower cylindrical bores and including control piston means mounted in and engaged with said upper cylindrical bore and accumulator piston means mounted in and engaged with said lower reduced diameter cylindrical bore; and (e) passageway means in said control housing for connecting said source of pressurized working fluid to said conduit means when said spool means is in its second position and for connecting said conduit means to exhaust when said spool means is in its first position.

10. The well penetrator of claim 9 additionally including biassing means for urging said spool means toward said first position.

11. The well penetrator of claim 10 wherein said spool means includes a spool passageway communicating said source of pressurized working fluid to a portion of the interior of said upper cylindrical bore for exerting a force on said spool means opposite to the force of said biassing means for urging said spool means toward said second position.

12. The well penetrator of claim 11 wherein said biassing means comprises pressurized gas acting on said accumulator piston.

13. The well penetrator of claim 12 wherein said control piston means of said spool comprises an upper control piston, a lower control piston and an intermediate control piston positioned between and spaced from said upper and lower control pistons, and spool rod means on which said control pistons are mounted including a reduced diameter rod portion having an outer surface and located between said intermediate control piston and said lower control piston cooperating with said upper bore and said intermediate control piston and said lower control piston to define a movable chamber and bore means communicating the movable chamber with said spool passageway in said spool so that said source of pressurized work fluid is in communication with said movable chamber.

14. The apparatus of claim 13 wherein the outer end of said movable punch member comprises two substantially planar surfaces intersecting along a transverse line extending substantially perpendicularly to a longitudinal axis of said punch member and wherein said punch member additionally includes cuttings removal passageways comprising a pair of arcuate grooves each respectively extending along the outer surface of opposite sides said punch member for conveying earh cuttings resultant from the operation of said nozzle means into casing.

15. A well penetrator as recited in claim 13 wherein said housing means additionally comprises an intermediate generally cylindrical lance cylinder housing having upper and lower ends and a lower punch cam housing having upper and lower ends wherein said control housing comprises an elongated generally cylindrical housing having upper and lower ends and wherein each of said housings includes fluid passageways and further including a first set of cooperating male-female connector means at the lower end of the control housing and the upper end of the lance cylinder housing for connecting the fluid passageways of said control housing to the fluid passageways of the lance cylinder housing and a second set of cooperating male-female connectors at the lower end of said lance cylinder housing and the upper end of said punch cam housing for connecting the fluid passageways of said punch cam housing to the fluid passageways of said lance cylinder housing and further including selectively operable mechanical connector means for connecting said control housing, said lance cylinder housing and said punch cam housing in end-to-end manner to provide and elongated rigid structure.

16. A well penetrator as recited in claim 7 wherein said hydraulic cylinder means has a head end chamber and a rod end chamber, said conduit means comprises a fixedly positioned elongated conduit extending lengthwise of said piston and rod assembly in a bore extending along the length of and through said piston and rod assembly so that said one end of said fixedly positioned elongated conduit is positioned in said head end chamber, an opening in said one end of said fixedly positioned elongated conduit positioned in said head end chamber whereby the discharge of pressurized work fluid from said opening effects movement of said piston and rod assembly toward said rod end chamber, and further including seal means mounted in said piston and rod assembly and engaging the outer surface of said fixedly positioned elongated conduit to hydraulically isolate said head end chamber from said rod end chamber while permitting said piston and rod assembly to reciprocate relative to said fixedly positioned elongated conduit.

17. A hydraulic power means as recited in claim 16 additionally including a second conduit means having one end communicating with said rod end chamber and an opposite end communicating with said control means, said control means additionally including means for connecting said second conduit to a source of pressurized work fluid when said fixedly positioned elongated conduit is connected to exhaust and vice versa.

18. The well penetrator of claim 17 wherein said control means includes:

(a) a control housing forming part of said housing;

(b) an upper cylindrical bore in said control housing and having upper and lower ends;

(c) a lower reduced diameter cylindrical bore coaxially adjacent to the lower end of said upper cylindrical bore but having a smaller diameter than said upper cylindrical bore;

(d) spool means mounted for reciprocation between first and second positions in said upper and lower cylindrical bores and including control piston means mounted in and engaged with said upper cylindrical bore and accumulator piston means mounted in and engaged with said lower reduced diameter cylindrical bore; and (e) passageway means in said control housing for connecting said source of pressurized working fluid to said conduit means when said spool means is in its second position and for connecting said conduit means to exhaust when said spool means is in its first position.

19. The well penetrator of claim 18 additionally including biassing means for urging said spool means toward said first position.

20. The well penetrator of claim 19 wherein said spool means includes a spool passageway communicating said source of pressurized working fluid to a portion of the interior of said upper cylindrical bore for exerting a force on said spool means opposite to the force of said biassing means for urging said spool means toward said second position.

21. The well penetrator of claim 20 wherein said biassing means comprises pressurized gas acting on said accumulator piston.

22. The well penetrator of claim 21 wherein said control piston means of said spool comprises an upper control piston, a lower control piston and an intermediate control piston positioned between and spaced from said upper and lower control pistons, and spool rod means on which said control pistons are mounted including a reduced diameter rod portion having an outer surface and located between said intermediate control piston and said lower control piston cooperating with said upper bore and said intermediate control piston and said lower control piston to define a movable chamber and bore means communicating the movable chamber with said spool passageway in said spool so that said source of pressurized work fluid is in communication with said movable chamber.

23. The apparatus of claim 22 wherein the outer end of said movable punch member comprises two substantially planar surfaces intersecting along a transverse line extending substantially perpendicularly to a longitudinal axis of said punch member and wherein said punch member additionally includes cuttings removal passageways comprising a pair of arcuate grooves each respectively extending along the outer surface of opposite sides said punch member for conveying earth cuttings resultant from the operation of said nozzle means into casing.

24. A well penetrator as recited in claim 21 wherein said housing means additionally comprises an intermediate generally cylindrical lance cylinder housing having upper and lower ends and a lower punch cam housing having upper and lower ends wherein said control housing comprises an elongated generally cylindrical housing having upper and lower ends and wherein each of said housings includes fluid passageways and further including a first set of cooperating male-female connector means at the lower end of the control housing and the upper end of the lance cylinder housing for connecting the fluid passageways of said control housing to the fluid passageways of the lance cylinder housing and a second set of cooperating male-female connectors at the lower end of said lance cylinder housing and the upper end of said punch cam housing for connecting the fluid passageways of said punch cam housing to the fluid passageways of said lance cylinder housing and further including selectively operable mechanical connector means for connecting said control housing, said lance cylinder housing and said punch cam housing in end-to-end manner to provide and elongated rigid structure.

25. The invention of claim 7 wherein said control means includes control cylinder means a pressure accumulator containing pressurized gas, an accumulator piston mounted for reciprocation in said accumulator between a first position and a second position with the pressurized gas in said accumulator tending to move the accumulator piston toward said first position, control rod means having an open interior and extending from said accumulator piston through said control cylinder means, a plurality of control pistons mounted on said control rod means and positioned in said control cylinder means and a hollow rod extension communicating the interior of said control rod means with said source of working fluid so that the pressure of the working fluid exerts a force on said control rod means opposite the force exerted by the pressurized gas in said accumulator so that the accumulator piston is shifted to its second position when the source of working fluid is at a pressure equal to or greater than a predetermined critical pressure.

26. The invention of claim 25 wherein said control pistons comprise an upper control piston, an intermediate control piston and a lower control piston and bore means for communicating said interior of said control rod means with a movable chamber defined by the exterior surface of said control rod means, the surface of said control cylinder and facing end surfaces of two of said control pistons.

27. In a well penetrator for penetrating the casing of a well of the type including a housing means, high pressure lance means having an inner end and an outer end and nozzle means on said outer end, said lance means being mounted for movement outwardly of the housing means through the casing of a well for penetrating the surrounding formation by the ejection of a high pressure jet from nozzle means on the outer end of the lance means, the improvement comprising power means mounted in said housing means for extending the lance means from the casing and retracting the lance means into the casing, said power means comprising first and second cylinder means mounted in the housing means, first and second piston means respectively mounted for reciprocation in said first and second cylinder means, rod means connecting said first and second piston means to each other and to the inner end of said lance means, sealing means engaging said rod means for hydraulically isolating said first and second cylinder means, selectively operable power fluid supply means in said housing means for selectively simultaneously supplying pressurized fluid to said first and second cylinder means at locations between said first and second piston means on opposite sides of said sealing means for selectively extending and retracting said lance means while simultaneously maintaining tension in said rod means.

28. The method of claim 6 wherein movement of said jet nozzle means outwardly through said punch member is effected by moving a pisotn rod drivingly connected to said jet nozzle means while simultaneously maintaining said piston rod in tension.

* * * * *